US010340073B2

(12) United States Patent
Lee et al.

(10) Patent No.: US 10,340,073 B2
(45) Date of Patent: Jul. 2, 2019

(54) COIL COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventors: Woo Jin Lee, Suwon-si (KR); Youn Soo Kim, Suwon-si (KR); Dong Hwan Lee, Suwon-si (KR); Ho Jin Yun, Suwon-si (KR); Ji Hyun Eom, Suwon-si (KR); Chan Yoon, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 127 days.

(21) Appl. No.: 15/215,210

(22) Filed: Jul. 20, 2016

(65) Prior Publication Data

US 2017/0032885 A1 Feb. 2, 2017

(30) Foreign Application Priority Data

Jul. 29, 2015 (KR) ..... 10-2015-0107021
Mar. 24, 2016 (KR) ..... 10-2016-0035328

(51) Int. Cl.
*H01F 5/00* (2006.01)
*H01F 27/28* (2006.01)
(Continued)

(52) U.S. Cl.
CPC ..... *H01F 27/292* (2013.01); *H01F 17/0033* (2013.01); *H01F 17/04* (2013.01); *H01F 41/046* (2013.01); *H01F 2017/048* (2013.01)

(58) Field of Classification Search
CPC ..... H01F 17/0033; H01F 2017/048
(Continued)

(56) References Cited

U.S. PATENT DOCUMENTS 5,097,243 A 3/1992 Zieren et al.
9,009,951 B2 4/2015 Chang et al.
(Continued)

FOREIGN PATENT DOCUMENTS

CN 103165259 A 6/2013
CN 103377795 A 10/2013
(Continued)

OTHER PUBLICATIONS

Office Action issued in corresponding Chinese Patent Application No. 201610617324.9, dated Oct. 11, 2017 (With full English Translation).

(Continued)

*Primary Examiner* — Ronald Hinson
(74) *Attorney, Agent, or Firm* — Morgan Lewis & Bockius LLP

(57) ABSTRACT

A coil component includes a body part containing a magnetic material, a coil part disposed in the body part, and an electrode part disposed on the body part. The coil part includes a support member, a first coil layer disposed on at least one surface of the support member, a first insulating layer stacked on at least one surface of the support member and covering the first coil layer, and a second coil layer disposed on the first insulating layer. The first and second coil layers are electrically connected to each other, and the second coil layer has a larger number of coil turns than the first coil layer. Additionally or alternatively, a conductor of the first coil layer has an aspect ratio less than 1. Methods of manufacturing such coil components are also provided.

20 Claims, 26 Drawing Sheets

(51) Int. Cl.

| | |
|---|---|
| ***H01F 27/29*** | (2006.01) |
| ***H01F 17/00*** | (2006.01) |
| ***H01F 17/04*** | (2006.01) |
| ***H01F 41/04*** | (2006.01) |

(58) Field of Classification Search
USPC ..... 336/200
See application file for complete search history.

(56) References Cited

U.S. PATENT DOCUMENTS

| | | | | |
|---|---|---|---|---|
| 9,236,173 | B2 | 1/2016 | Yoo et al. | |
| 2002/0157849 | A1* | 10/2002 | Sakata | H01F 17/0013 174/546 |
| 2003/0076211 | A1* | 4/2003 | Matsuta | H01F 17/0013 336/200 |
| 2007/0085121 | A1 | 4/2007 | Mikura et al. | |
| 2008/0204183 | A1* | 8/2008 | Loza | H01F 17/0013 336/200 |
| 2013/0147592 | A1 | 6/2013 | Yoo et al. | |
| 2013/0249662 | A1 | 9/2013 | Tonoyama et al. | |
| 2013/0335186 | A1* | 12/2013 | Chang | H01F 5/003 336/200 |
| 2015/0035640 | A1 | 2/2015 | Wang et al. | |
| 2015/0048918 | A1 | 2/2015 | Park et al. | |

FOREIGN PATENT DOCUMENTS

| | | | |
|---|---|---|---|
| CN | 104347262 | A | 2/2015 |
| JP | 05-029147 | A | 2/1993 |
| JP | 05-066943 | A | 3/1993 |
| JP | H07-045476 | A | 2/1995 |
| JP | 7-86040 | A | 3/1995 |
| JP | 2000-114041 | A | 4/2000 |
| JP | 2006-278479 | A | 10/2006 |
| JP | 2006-310777 | A | 11/2006 |
| JP | 5730841 | B2 | 6/2015 |
| KR | 10-2013-0109047 | A | 10/2013 |
| KR | 10-2015-0019588 | A | 2/2015 |
| KR | 10-2015-0071266 | A | 6/2015 |

OTHER PUBLICATIONS

Office Action issued in corresponding Korean Patent Application No. 10-2016-0035328, dated May 29, 2017 with English Translation.

Chinese Office Action dated Jan. 31, 2019 issued in Chinese Patent Application No. 201610617324.9 (with English translation).

* cited by examiner

THIRD DIRECTION

FIRST DIRECTION

COIL COMPONENT AND METHOD OF MANUFACTURING THE SAME

CROSS-REFERENCE TO RELATED APPLICATION(S)

This application claims benefit of priority to Korean Patent Application No. 10-2015-0107021 filed on Jul. 29, 2015, and Korean Patent Application No. 10-2016-0035328 filed on Mar. 24, 2016 in the Korean Intellectual Property Office, the disclosures of which are incorporated herein by reference in their entireties.

BACKGROUND

1. Field

The present disclosure relates to a coil component and a method of manufacturing the same.

2. Description of Related Art

In accordance with the miniaturization and thinning of electronic devices such as digital televisions (TV), mobile phones, laptop computers, and the like, coil components used in such electronic devices correspondingly need to be miniaturized and thinned. In order to demand for such components, research into and development of various winding type or thin film type coil components have been actively conducted.

As part of the miniaturization and the thinning of coil components, miniaturized and thinned coil components need to provide characteristics equal to the characteristics of existing coil components in spite of the miniaturization and the thinning. In order to satisfy this demand, a core in which a magnetic material is filled and which has a low direct current (DC) resistance $R_{dc}$ having a sufficient size needs to be secured. To achieve this end, coil components having coil patterns with increased aspect ratios and coil parts having increased cross-sectional areas have been developed using, for example, an anisotropic plating technology.

However, when coil components are manufactured using the anisotropic plating technology in a limited space due to the requirements for miniaturization and thinning, the risks of defects are increased including defects resulting from a decrease in uniformity of plating growth, the occurrence of short-circuits between coil parts, and the like, due to an increase in an aspect ratio.

SUMMARY

An aspect of the present disclosure provides a coil component in which a risk of occurrence of a defect, such as a short-circuit or the like, may be decreased and uniformity of coils and a low direct current (DC) resistance $R_{dc}$ may be secured. A method of manufacturing the same provides similar advantages.

One of several solutions presented includes increasing the number of coil turns or windings in a stacking direction of a plurality of stacked coil layers by stably forming the plurality of coil layers using insulating layers on a support member.

According to an aspect of the present disclosure, a coil component may include a body part containing a magnetic material, a coil part disposed in the body part, and an electrode part disposed on the body part. The coil part includes a support member, a first coil layer disposed on at least one surface of the support member, a first insulating layer stacked on at least one surface of the support member and covering the first coil layer, and a second coil layer disposed on the first insulating layer. The first and second coil layers are electrically connected to each other, and the second coil layer has a larger number of coil turns than the first coil layer.

According to another aspect of the present disclosure, a method of manufacturing a coil component may include forming a coil part, forming a body part accommodating the coil part therein, and forming an electrode part on the body part. The coil part is formed by forming a first coil layer on at least one surface of a support member by plating, stacking a first insulating layer on at least one surface of the support member so as to cover the first coil layer, and forming a second coil layer on the first insulating layer by plating. The first and second coil layers are electrically connected to each other, and the second coil layer has a larger number of coil turns than the first coil layer.

According to a further aspect of the present disclosure, a coil component includes a body part containing a magnetic material, a coil part disposed in the body part, and an electrode part disposed on the body part. The coil part includes a support member, a first coil layer disposed on one surface of the support member, a first insulating layer stacked on the one surface of the support member and covering the first coil layer, and a second coil layer disposed on the first insulating layer. The first and second coil layers are electrically connected to each other, and a conductor of the first coil layer has an aspect ratio $h_1/w_1$ less than 1 where a thickness $h_1$ is measured orthogonally to the one surface of the support member on which the first coil layer is disposed and a width $w_1$ is measured parallel to the one surface of the support member.

BRIEF DESCRIPTION OF DRAWINGS

The above and other aspects, features, and advantages of the present disclosure will be more clearly understood from the following detailed description taken in conjunction with the accompanying drawings, in which:

FIG. 6 is a schematic cross-sectional view of a body part of the coil component of FIG. 5 viewed in direction a;

DETAILED DESCRIPTION

Figure 1:
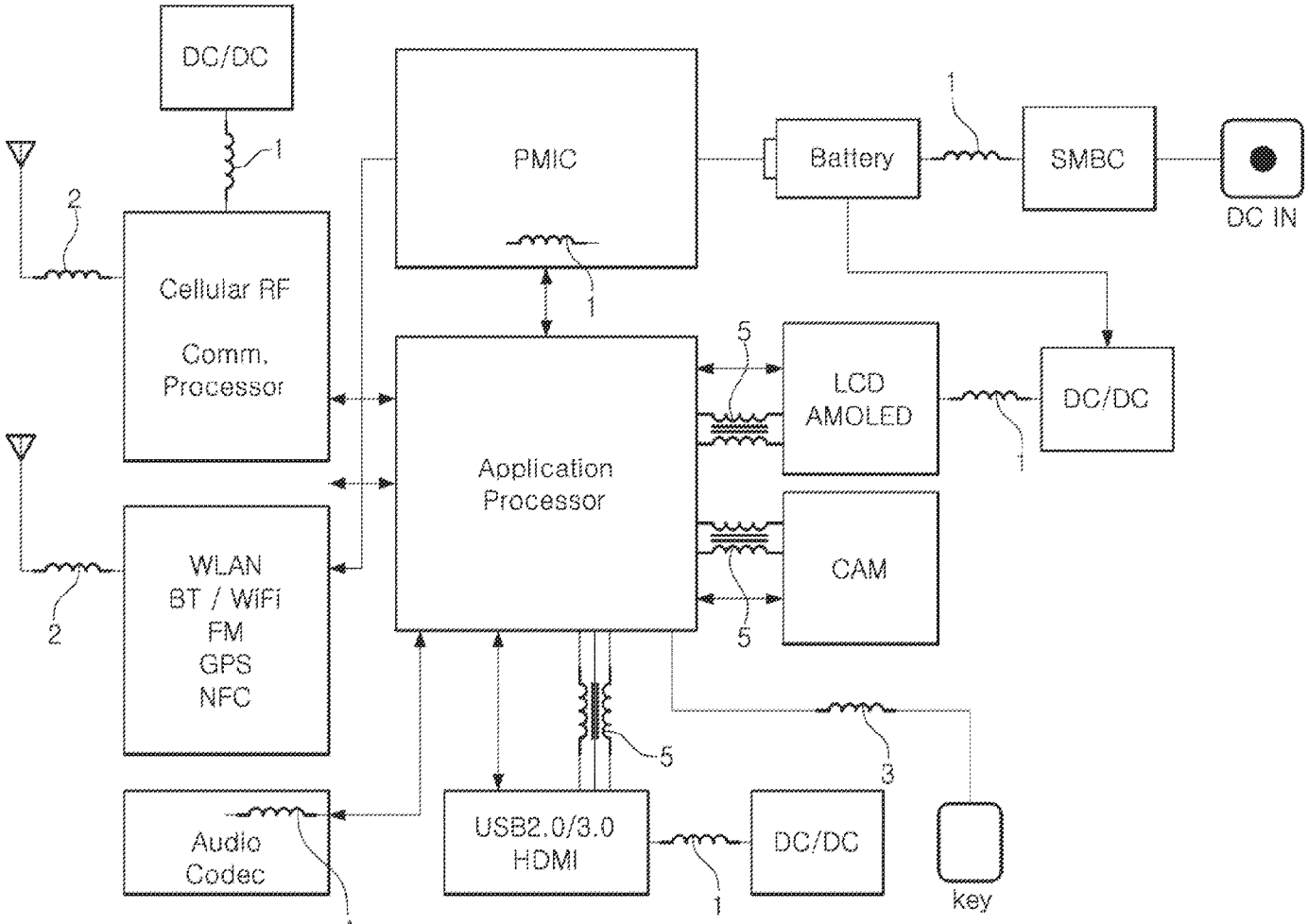
FIG. 1 is a view schematically illustrating an example of a coil component used in an electronic device.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers, and/or sections, these members, components, regions, layers, and/or sections should not be limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the exemplary embodiments.

Spatially relative terms, such as "above," "upper," "below," "lower," and the like, may be used herein for ease of description to describe one element's positional relationship relative to one or more other elements as shown in the figures. It will be understood that the spatially relative terms are intended to encompass different orientations of the device in use or operation in addition to the orientation depicted in the figures. For example, if the device in the figures is turned over, elements described as "above" or "upper" relative to other elements would then be oriented "below" or "lower" relative to the other elements or features. Thus, the term "above" can encompass both the above and below orientations depending on a particular direction of the devices, elements, or figures. The device may be otherwise oriented (rotated 90 degrees or at other orientations) and the spatially relative descriptors used herein may be interpreted accordingly.

The terminology used herein is for describing particular illustrative embodiments only and is not intended to be limiting of the present disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, members, elements, and/or groups, but do not preclude the presence or addition of one or more other features, integers, steps, operations, members, elements, and/or groups.

Hereinafter, embodiments of the present disclosure will be described with reference to schematic views illustrating embodiments. In the drawings, components having ideal shapes are shown. However, variations from these ideal shapes, for example due to variability in manufacturing techniques and/or tolerances, also fall within the scope of the disclosure. Thus, embodiments of the present disclosure should not be construed as being limited to the particular shapes of regions shown herein, but should more generally be understood to include changes in shape resulting from manufacturing methods and processes. The following embodiments may also be constituted by one or a combination thereof.

The present disclosure describes a variety of configurations, and only illustrative configurations are shown herein.

However, the disclosure is not limited to the particular illustrative configurations presented herein, but extends to other similar/analogous configurations as well.

Electronic Device

FIG. 1 is a view schematically illustrating an example of a coil component used in an electronic device.

Referring to FIG. 1, it may be appreciated that various kinds of electronic components may be used in an electronic device. For example, the electronic device of FIG. 1 includes, in addition to various coil components, one or more of an application processor, a direct current (DC) to DC (DC/DC) converter, a communications processor such as a communications processor for cellular radio-frequency (RF) communications, one or more transceivers configured for communication using a wireless local area network (WLAN), Bluetooth (BT), wireless fidelity (WiFi), frequency modulation (FM), global positioning system (GPS), and/or near field communications (NFC) standard, a power management integrated circuit (PMIC), a battery, a switch-mode battery charger (SMBC), a liquid crystal display (LCD) and/or active matrix organic light emitting diode (AMOLED) display, an audio codec, a universal serial bus (USB) 2.0/3.0 interface and/or a high definition multimedia interface (HDMI), a conditional access module (CAM), and the like. Here, various kinds of coil components may be appropriately used between these electronic components and/or in the electronic components depending on their purposes in order to remove noise, or the like. For example, the electronic device can include one or more power inductors 1, high frequency (HF) inductors 2, general beads 3, beads 4 for high frequency (e.g., GHz) applications, common mode filters 5, and the like.

In detail, the power inductors 1 may be used to store electricity in magnetic field form to maintain an output voltage, thereby stabilizing power. In addition, the high frequency (HF) inductors 2 may be used to perform impedance matching to secure a required frequency or cut off noise and an alternating current (AC) component. Further, the general beads 3 may be used to remove noise of power and signal lines or remove a high frequency ripple. Further, the beads 4 for high frequency (e.g., GHz) applications may be used to remove high frequency noise of a signal line and a power line related to an audio. Further, the common mode filters 5 may be used to pass a current therethrough in a differential mode and remove only common mode noise.

A representative example of the electronic device may be a smart phone, but is not limited thereto. The electronic device may also be, for example, a personal digital assistant, a digital video camera, a digital still camera, a network system, a computer, a monitor, a television, a video game, a smart watch, or the like. The electronic device may also be various other electronic devices in addition to the devices described above.

Coil Component

Hereinafter, a coil component according to the present disclosure, particularly an inductor, will be described for convenience of explanation. However, the coil component may alternatively take the form of any of the other coil components described above.

Figure 2:
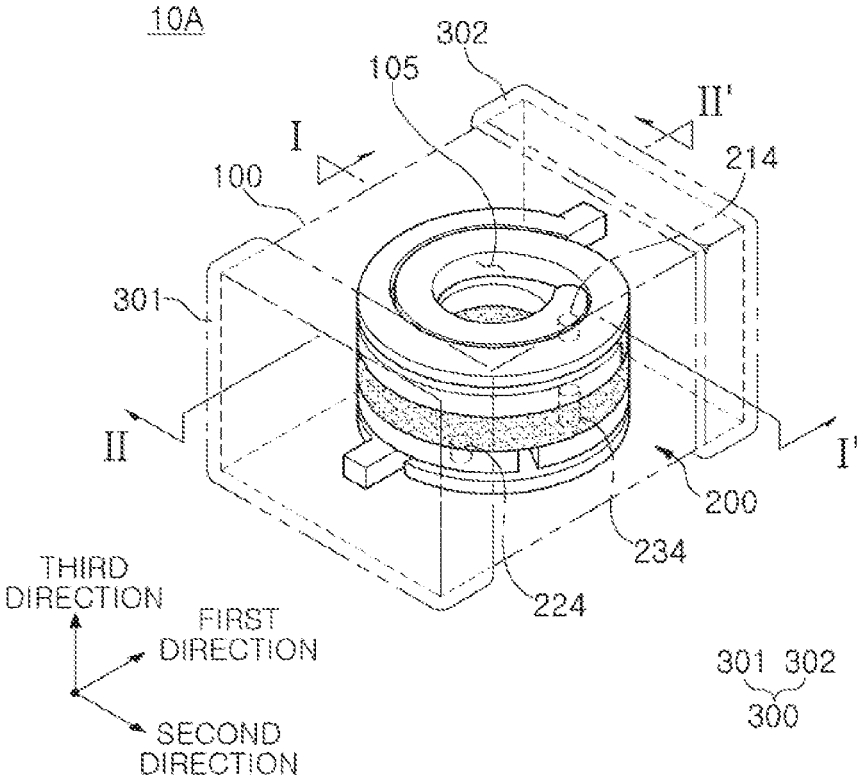
FIG. 2 is a schematic perspective view illustrating an example of a coil component.

FIG. 2 is a schematic perspective view illustrating an example of a coil component.

Figure 3:
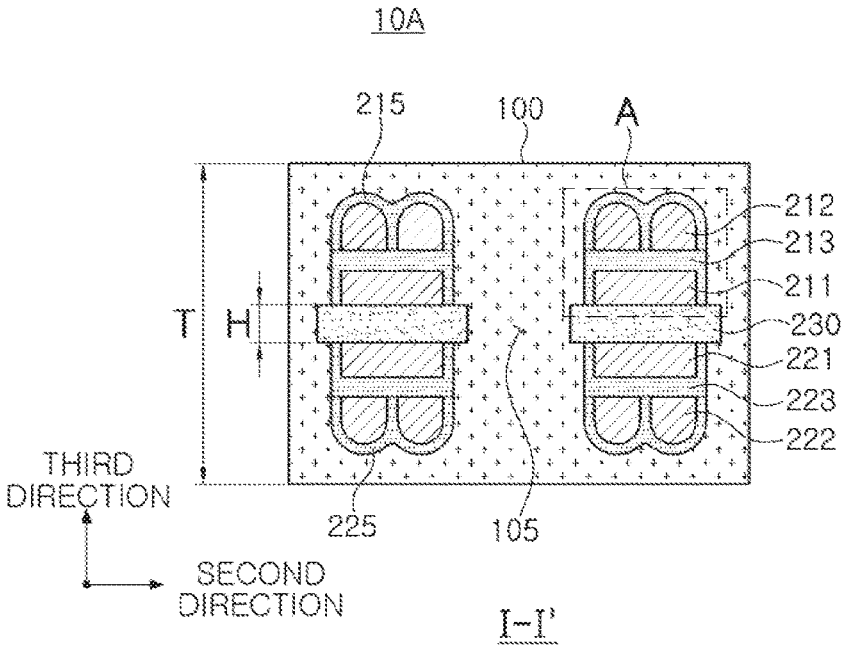
FIG. 3 is a schematic cross-sectional view of the coil component of FIG. 2 taken along line I-I'.

FIG. 3 is a schematic cross-sectional view of the coil component of FIG. 2 taken along line I-I'.

Figure 4:
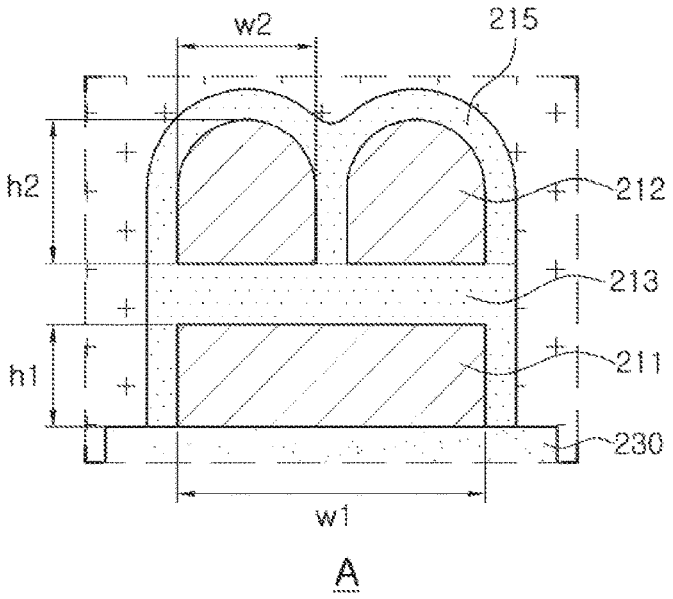
FIG. 4 is a schematic enlarged cross-sectional view of region A of the coil component of FIG. 3.

FIG. 4 is a schematic enlarged cross-sectional view of region A of the coil component of FIG. 3.

Referring to FIGS. 2 through 4, a coil component 10A according to an example may have a structure in which a coil part 200 is disposed in a body part 100 containing a magnetic material. An electrode part 300 electrically connected to the coil part 200 may be disposed on an outer surface of the body part 100. The coil part 200 may include a support member 230 and a plurality of coil layers 211, 212, 221, and 222 disposed on both surfaces of the support member 230. Insulating layers 213 and 223 disposed on both surfaces of the support member 230 and each covering a corresponding one of first coil layers 211 and 221 formed in an inner portion may be disposed between first and second coil layers 211 and 212 formed in an upper portion and between first and second coil layers 221 and 222 formed in a lower portion, respectively.

The body part 100 may form an exterior of the coil component 10A. The body part 100 may have first and second surfaces opposing each other in a first direction, third and fourth surfaces opposing each other in a second direction, and fifth and sixth surfaces opposing each other in a third direction. The body part 100 may have an approximately hexahedral shape, but is not limited thereto. Six corners at which the first to sixth surfaces meet each other may be rounded by grinding, or the like. The body part 100 may contain a magnetic material having magnetic properties. For example, the body part 100 may be formed by mixing ferritic and/or magnetic metal particles in a resin. The ferrite may be a material such as Mn—Zn based ferrite, Ni—Zn based ferrite, Ni—Zn—Cu based ferrite, Mn—Mg based ferrite, Ba based ferrite, Li based ferrite, or the like. The magnetic metal particles may contain one or more selected from the group consisting of iron (Fe), silicon (Si), chromium (Cr), aluminum (Al), and nickel (Ni). For example, the magnetic metal particles may be Fe—Si—B—Cr based amorphous metal particles, but are not necessarily limited thereto. The magnetic metal particles may have diameters of about 0.1 μm to 30 μm. The body part 100 may have a form in which the ferrites and/or the magnetic metal particles are dispersed in a thermosetting resin such as an epoxy resin, a polyimide resin, or the like. A thickness T of the body part 100 (and other dimensions of the body part 100) may be changed depending on characteristics of an electronic device in which the coil component is used, and may be approximately 500 μm to 900 μm, but is not limited thereto.

The coil part 200 may perform various functions in the electronic device through a property appearing in a coil of the coil component 10A. For example, the coil component 10A may be a power inductor. In this case, the coil part 200 may serve to store electricity in a magnetic field form to maintain an output voltage, thereby stabilizing power. The plurality of coil layers 211, 212, 221, and 222 respectively stacked on surfaces of the support member 230 may be electrically connected to each other through a via 234 penetrating through the support member 230. The coil layers 211 and 221 disposed in the inner portion among the plurality of coil layers 211, 212, 221, and 222 and the coil layers 212 and 222 disposed in the outer portion among the plurality of coil layers 211, 212, 221, and 222 may be electrically connected to each other through vias 214 and 224 penetrating through the insulating layers 213 and 223 disposed between the coil layers 211 and 221 and the coil layers 212 and 222. As a result, the plurality of coil layers 211, 212, 221, and 222 may be electrically connected to each other to form a single coil. A through-hole 105 may be formed in a central portion of the coil part 200. The through-hole 105 may be filled with the magnetic material constituting the body part 100. The coil part 200 may include the first coil layers 211 and 221 formed on respective opposing surfaces of the support member 230, that is, stacked in the inner portion, and the second coil layers 212 and 222 formed on the insulating layers 213 and 223, that is, stacked in the outer portion on top of and below the first coil layers 211 and 221, respectively. The insulating layers 213 and 223 may be disposed between the first coil layers 211 and 221 and the second coil layers 212 and 222, respectively. The second coil layers 212 and 222 may be covered by insulating films 215 and 225, respectively.

Cross sections of the conductors of the coil patterns of the first coil layers 211 and 221 may have an aspect ratio (AR), which is a ratio ($h_1/w_1$) of a thickness $h_1$ to a width $w_1$, less than 1 (where $h_1$ is measured orthogonally to the opposing surfaces of the support member 230 on which the first coil layers 211 and 221 are disposed, and $w_1$ is measured parallel to the opposing surfaces). Cross sections of the conductors of the coil patterns of the second coil layers 212 and 222 may have an aspect ratio (AR), which is a ratio ($h_2/w_2$) of a thickness $h_2$ to a width $w_2$, exceeding 1 (where $h_2$ is measured orthogonally to the opposing surfaces of the support member 230 on which the first coil layers 211 and 221 are disposed, and $w_2$ is measured parallel to the opposing surfaces). That is, in the coil component 10A according to an example, the aspect ratios of the cross sections of the conductors of the coil patterns of the first coil layers 211 and 221 and the second coil layers 212 and 222 may be different from each other. For example, the conductors of the coil patterns of the first coil layers 211 and 221 may have a width $w_1$ of about 160 μm to 190 μm and a thickness $h_1$ of about 60 μm to 90 μm, and the conductors of the coil patterns of the second coil layers 212 and 222 may have a width $w_2$ of about 60 μm to 90 μm and a thickness $h_2$ of about 90 μm to 120 μm.

Meanwhile, direct current (DC) resistance $R_{dc}$ characteristics, among main characteristics of the coil component such as the inductor, may be reduced as a cross-sectional area of the coil part 200 is increased. In addition, an inductance may become large as an area of a magnetic region in the body part 100 through which a magnetic flux passes is increased. Therefore, in order to decrease the DC resistance $R_{dc}$ and increase the inductance, the cross-sectional area of the coil part 200 needs to be increased and the area of the magnetic region needs to be increased. As a method of increasing the cross-sectional area of the coil part 200, there are a method of increasing widths (e.g., $w_1$ and $w_2$) of the conductors of the coil patterns and a method of increasing thicknesses (e.g., $h_1$ and $h_2$) of the conductors of the coil patterns. However, in a case of simply increasing the width of the conductors of the coil patterns, there is a risk that short-circuits between adjacent coil patterns will occur. In addition, a limitation is generated in the number of turns of coil patterns that may be implemented, and an area occupied by the magnetic region is decreased, such that efficiency is decreased, and a limitation is also generated in implementing a high inductance product. In order to overcome these limitations, implementation of a coil pattern conductor having a high aspect ratio obtained by increasing a thickness of the coil pattern conductor without increasing a width of the coil pattern conductor has been demanded.

Figure 34:
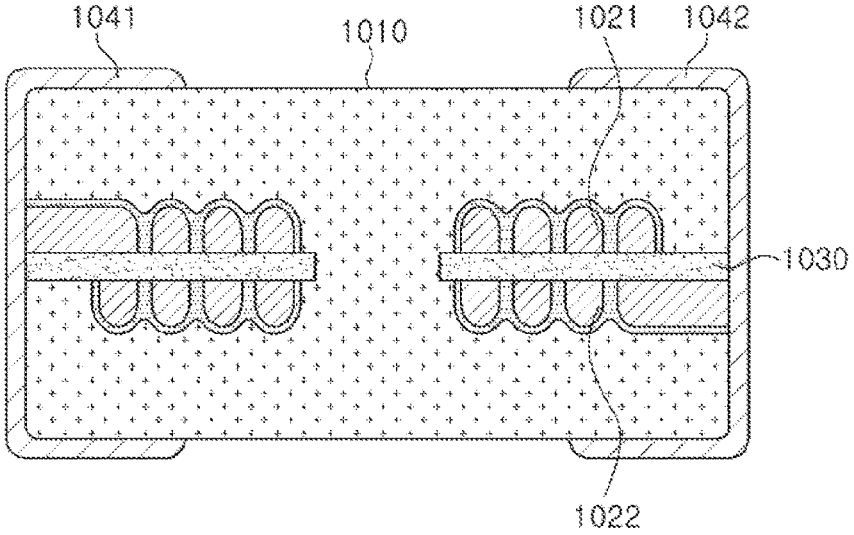
FIG. 34 is a schematic view illustrating an example of a coil component to which an isotropic plating technology is applied.

Meanwhile, FIG. 34 is a schematic view illustrating an example of a coil component to which an isotropic plating technology is applied. The coil component to which the isotropic plating technology is applied may be manufactured by, for example, forming coil patterns 1021 and 1022 each having a planar coil shape on opposing surfaces of a support member 1030 by the isotropic plating technology, embedding the coil patterns 1021 and 1022 using a magnetic material to form a body part 1010, and forming external electrodes 1041 and 1042 respectively electrically connected to the coil patterns 1021 and 1022 on outer surfaces of the body part 1010. However, the isotropic plating technology has a limitation in implementing a high aspect ratio as illustrated in FIG. 34, since plating is performed at the time of performing an electroplating method, such that coil patterns are simultaneously grown in a thickness direction and a width direction.

Figure 35:
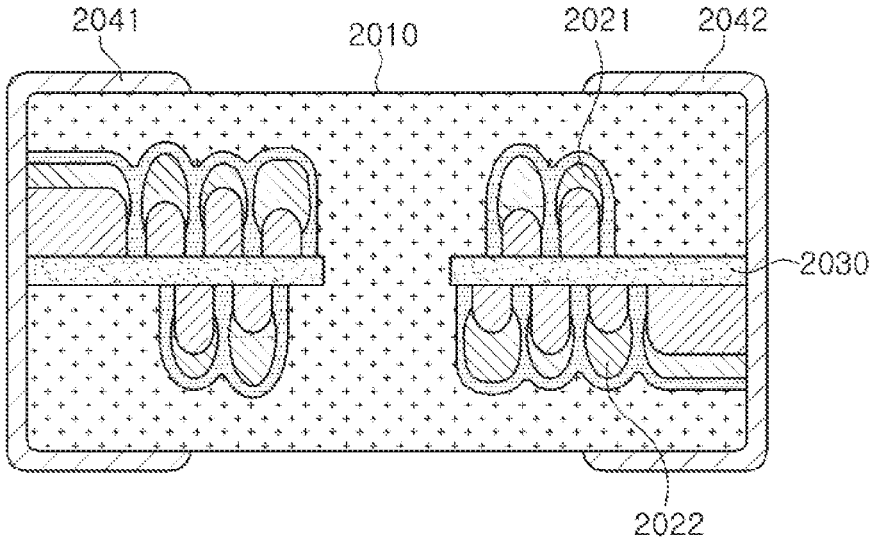
FIG. 35 is a schematic view illustrating an example of a coil component to which an anisotropic plating technology is applied.

Meanwhile, FIG. 35 is a schematic view illustrating an example of a coil component to which an anisotropic plating technology is applied. The coil component to which the anisotropic plating technology is applied may be manufactured by, for example, forming coil patterns 2021 and 2022 each having a planar coil shape on opposing surfaces of a support member 2030 by the anisotropic plating technology, embedding the coil patterns 2021 and 2022 using a magnetic material to form a body part 2010, and forming external electrodes 2041 and 2042 respectively electrically connected to the coil patterns 2021 and 2022 on outer surfaces of the body part 2010. However, in the case of applying the anisotropic plating technology, a high aspect ratio may be implemented, but uniformity of plating growth may be decreased due to an increase in an aspect ratio, and a dispersion of a plating thickness is wide, such that short-circuits between adjacent coil windings or patterns may easily occur.

On the other hand, in a case in which the aspect ratio of the conductors of the coil patterns of the first coil layers 211 and 221 is less than 1 as in the coil component 10A according to an example, a height and a width of the coil patterns may be freely adjusted within a dispersion allowed by a process technology used for forming the coil patterns, such that uniformity of the coil pattern conductors may be excellent, and the coil pattern conductors are wide in the width direction, such that the cross-sectional area of the conductors of the coil part is increased, whereby low DC resistance $R_{dc}$ characteristics may be implemented. In addition, in a case in which the aspect ratio of the coil pattern conductors of the second coil layers 212 and 222 exceeds 1, the coil patterns of the second coil layers 212 and 222 may each have a number of turns (or windings) higher than that of the coil patterns of the first coil layers 211 and 221 on the same plane. That is, the cross-sectional area of the conductor forming each winding of the coil part is decreased, but the number of turns (or windings) may be further increased, which is particularly useful for implementing a high inductance.

In addition, in the coil component 10A according to an example, the aspect ratios of the coil pattern conductors of the first coil layers 211 and 221 may be less than 1, such that thicknesses of the coil pattern conductors of the first coil layers 211 and 221 may be basically thin, and the aspect ratios of the coil pattern conductors of the second coil layers 212 and 222 may exceed 1, but line widths themselves of the coil pattern conductors of the second coil layers 212 and 222 may be thinly implemented, such that widths of the coil pattern conductors of the second coil layers 212 and 222 may not be very thick. In addition, in order to have a sufficient number of turns (or windings), the respective coil layers 211, 221, 212, and 222 may be formed to utilize spaces as much as possible in horizontal directions, that is, a first direction and/or a second direction (e.g., directions parallel to the opposing surfaces of the support member 230 on which the first coil layers 211 and 221 are disposed). That is, the first coil layers 211 and 221 and the second coil layers 212 and 222 stacked in a vertical direction may have overlapped regions. Therefore, a coil component that is thin and has sufficient coil characteristics may be implemented.

The coil pattern conductors of the first coil layers 211 and 221 may have the aspect ratio, which is the ratio ($h_1/w_1$) of the thickness $h_1$ to the width $w_1$, less than 1, as described above. In addition, the number of turns (or windings) of the coil patterns of the first coil layers 211 and 221 may be one. Here, the meaning that the number of turns is one is that the number of turns is 1 or less (e.g., an incomplete turn). On the other hand, the coil pattern conductors of the second coil layers 212 and 222 may have the aspect ratio, which is the ratio ($h_2/w_2$) of the thickness $h_2$ to the width $w_2$, exceeding 1, as described above. In addition, the number of turns (or windings) of the coil patterns of the second coil layers 212 and 222 may be plural. Here, the meaning that the number of turns is plural is that the number of turns exceeds 1. Therefore, as described above, the cross-sectional area of the coil part is decreased, but the number of turns may be further increased, which is particularly useful for implementing the high inductance.

When the number of turns of the coil patterns of the first coil layers 211 and 221 is x and the number of turns of the coil patterns of the second coil layers 212 and 222 is y, a ratio (y/x) of y to x may be 2 or more. For example, the ratio (y/x) of y to x may be about 2 to 3 (or within the range of 2 to 3). In this case, disadvantages of the isotropic plating technology and the anisotropic plating technology may be countered, and the number of turns may be increased, such that a higher degree of inductance may be implemented.

Only the first coil layers 211 and 221 and the second coil layers 212 and 222 are illustrated in the drawings, but additional coil layers may be further formed on (e.g., stacked on and/or below) the second coil layers 212 and 222, and insulating layers in which vias are formed may be disposed between the additional coil layers and the second coil layers 212 and 222, such that the additional coil layers and the second coil layers 212 and 222 may be electrically connected to each other. In this case, the same contents or materials as the first coil layers 211 and 221 or the second coil layers 212 and 222 may be applied to the additional coil layers. In addition, additional coil layers may be further formed between the first coil layers 211 and 221 and the second coil layers 212 and 222, and insulating layers in which vias are formed may be disposed between the additional coil layers and the first coil layers 211 and 221 or the second coil layers 212 and 222, such that the additional coil layers and the first coil layers 211 and 221 or the second coil layers 212 and 222 may be electrically connected to each other. In this case, the same contents or materials as the first coil layers 211 and 221 or the second coil layers 212 and 222 may also be applied to the additional coil layers.

A material or a kind of the support member 230 is not particularly limited as long as the support member 230 may support the plurality of coil layers 211, 212, 221, and 222. For example, the support member 230 may be a copper clad laminate (CCL), a polypropylene glycol (PPG) substrate, a ferrite substrate, a metal based soft magnetic substrate, or the like. In addition, the support member 230 may be an insulating substrate formed of an insulating resin. The insulating resin may be a thermosetting resin such as an epoxy resin, a thermoplastic resin such as a polyimide resin, a resin having a reinforcing material such as a glass fiber or an inorganic filler impregnated in the thermosetting resin and the thermoplastic resin, such as pre-preg, Ajinomoto Build up Film (ABF), FR-4, a Bismaleimide Triazine (BT) resin, a photo-imageable dielectric (PID) resin, or the like. An insulating substrate containing a glass fiber and an epoxy resin may be used in terms of maintenance of rigidity, but is not limited thereto. A thickness T of the support member 230 (e.g., the smallest dimension of the support member 230) may be 80 μm or less, preferably 60 μm or less, more preferably, 40 μm or less, but is not limited thereto.

When a thickness of the support member 230 is H and a thickness of the body part 100 is T, a ratio (H/T) of H to T may be 0.15 or less, for example, about 0.05 to 0.10. In a case in which a ratio occupied by the thickness of the support member 230 in the body part 100 exceeds 0.15, thicknesses of magnetic materials disposed in upper and lower portion of the coil part 200 may become comparatively thin, which may cause a decrease in an inductance. In addition, as the thickness of the support member 230 is increased, a thickness of the via 234 formed in the support member 230 and extending through the support member 230 is increased, such that a current path between the plurality of coil layers 211, 212, 221, and 222 stacked on opposing surfaces of the support member 230 is increased. As a result, an inductance, a DC resistance $R_{dc}$, and the like, may be decreased. However, in order to maintain rigidity, it may be disadvantageous that the thickness of the support member 230 is excessively thin.

A shape or a material of the via 234 penetrating through the support member 230 is not particularly limited as long as the via 234 may electrically connect the first coil layers 211 and 221 disposed on opposing surfaces of the support member 230. That is, the first coil layer 211 may be disposed in the upper surface or portion of the support member 230 and the first coil layer 221 may be disposed in the lower surface or portion of the support member 230, and the first coil layers 211 and 221 may be electrically connected to each other by the via 234. Here, the upper portion and the lower portion are decided in relation to a third direction as indicated in the drawings. The via 234 may have any of a variety of different shapes. For example, the via 234 may have any shape, such as a taper shape of which a diameter is reduced or increased from an upper surface toward a lower surface, a cylindrical shape of which a diameter is substantially constant from an upper surface toward a lower surface, an hourglass shape, and the like. In addition, a conductive material such as copper (Cu), aluminum (Al), silver (Ag), tin (Sn), gold (Au), nickel (Ni), lead (Pd), or alloys thereof, or the like, may be used as a material of the via 234.

The insulating layers 213 and 223 may serve to insulate the first coil layers 211 and 221 and the second coil layers 212 and 222 from each other, respectively. The insulating layers 213 and 223 may be a build-up film containing an insulating material. For example, a thermosetting resin such as an epoxy resin, a thermoplastic resin such as a polyimide resin, a resin having a reinforcing material such as an inorganic filler impregnated in the thermosetting resin and the thermoplastic resin, such as ABF, or the like, may be used as the insulating layers 213 and 223. Alternatively, the insulating layers 213 and 223 may be an insulating film containing a photo-imageable dielectric (PID) resin. The insulating layers 213 and 223 may have a thickness greater than that of the first coil layers 211 and 221 to be sufficient to insulate the first coil layers 211 and 221 from the second coil layers 212 and 222 while covering the first coil layers 211 and 221, respectively. An insulation distance between the first coil layers 211 and 221 and the second coil layers 212 and 222 by the insulating layers 213 and 223 may be, for example, about 3 μm to 20 μm, but is not limited thereto.

Shapes or materials of the vias 214 and 224 penetrating through the insulating layers 213 and 223 are not particularly limited as long as the vias 214 and 224 may respectively electrically connect the first coil layers 211 and 221 and the second coil layers 212 and 222 to each other. The vias 214 and 224 may have any of a variety of different shapes. For example, the vias 214 and 224 may have any shape, such as the taper shape, the cylindrical shape, and the like, as described above. In addition, a conductive material such as copper (Cu), aluminum (Al), silver (Ag), tin (Sn), gold (Au), nickel (Ni), lead (Pd), or alloys thereof, or the like, may be used as the materials of the vias 214 and 224. A thickness (e.g., measured in the third direction) of the insulating layers 213 and 223 may be generally thinner than that of the support member 230.

The insulating films 215 and 225 may serve to protect the second coil layers 212 and 222, respectively. Any material containing an insulating material may be used as materials of the insulating films 215 and 225. Materials of the insulating films 215 and 225 may be an insulating material used for general insulation coating, for example, an epoxy resin, a polyimide resin, a liquid crystalline polymer resin, or the like, or may be a photo-imageable dielectric (PID) resin, or the like, but are not limited thereto. The insulating films 215 and 225 may be integrated with the insulating layers 213 and 223, respectively, depending on a manufacturing method, but are not limited thereto.

The electrode part 300 may include first and second external electrodes 301 and 302 disposed on the body part 100 so as to be spaced apart from each other and each electrically connected to a lead terminal of a respective one of the second coil layers 212 and 222. The external electrodes 301 and 302 may serve to electrically connect the coil part 200 in the coil component 10A to the electronic device when the coil component 10A is mounted in the electronic device. The external electrodes 301 and 302 may include, for example, conductive resin layers and plating layers formed on the conductive resin layers. The conductive resin layer may contain one or more conductive metal(s) selected from the group consisting of copper (Cu), nickel (Ni), and silver (Ag), and a thermosetting resin. The plating layer may contain one or more selected from the group consisting of nickel (Ni), copper (Cu), and tin (Sn). For example, a nickel (Ni) layer and a tin (Sn) layer may be sequentially formed in the plating layer.

Figure 5:
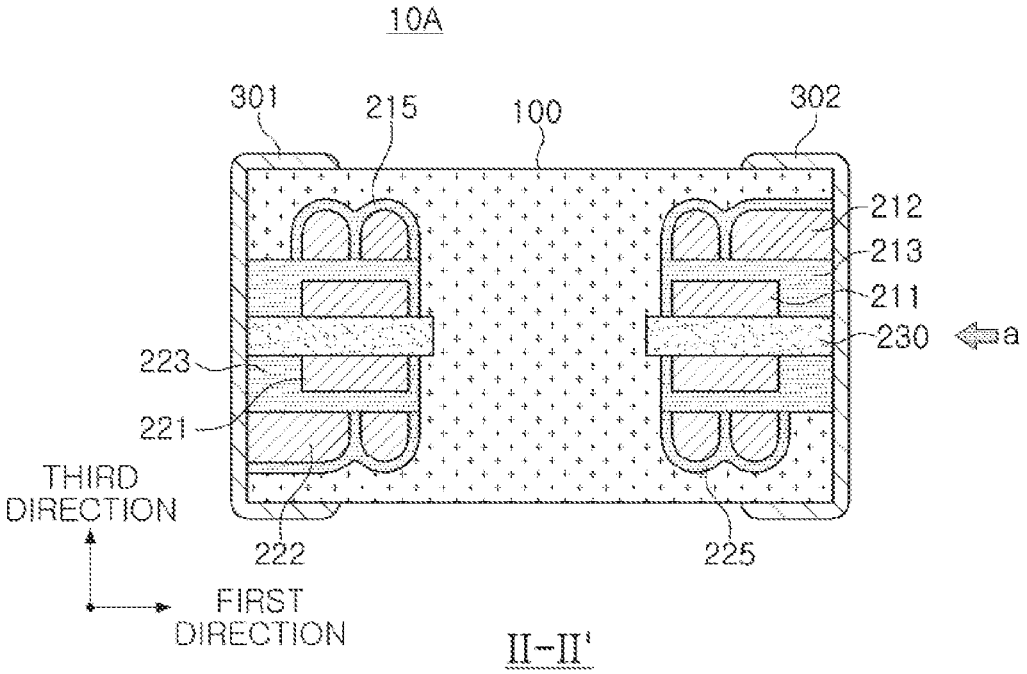
FIG. 5 is a schematic cross-sectional view of the coil component of FIG. 2 taken along line II-II'.

FIG. 5 is a schematic cross-sectional view of the coil component of FIG. 2 taken along line II-II'.

Figure 6:
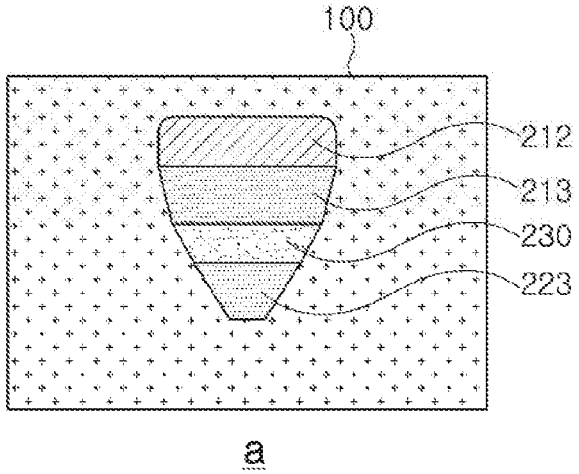

FIG. 6 is a schematic cross-sectional view of a body part of the coil component of FIG. 5 viewed in direction a.

Referring to FIGS. 5 and 6, a right lead cross section of the coil part 200 may include a lead cross section of the support member 230, lead cross sections of the insulating layers 213 and 223 each disposed in an upper portion and a lower portion on the lead cross section of the support member 230, and a lead cross section of the second coil layer 212 disposed in an upper portion on the lead cross section of the insulating layer 213 disposed in the upper portion. In addition, a left lead cross section of the coil part 200 may include a lead cross section of the support member 230, lead cross sections of the insulating layers 213 and 223 each disposed in an upper portion and a lower portion on the lead cross section of the support member 230, and a lead cross section of the second coil layer 222 disposed in an lower portion on the lead cross section of the insulating layer 213 disposed in the lower portion. That is, lead terminals of coil patterns led in order to be connected to the external electrodes 301 and 302 may be supported by the support member 230 and the insulating layers 213 and 223. Therefore, the lead terminals of the coil patterns may be stably formed, and may have excellent connection force to the external electrodes 301 and 302. Here, the left and the right are defined in relation to the first direction in FIGS. 5 and 6. In addition, the top and the bottom are defined in relation to the third direction in FIGS. 5 and 6. Meanwhile, although the insulating film 215 is omitted in FIG. 6, the insulating film 215 may also be led. Alternatively, the insulating film 215 may also not substantially remain in the lead cross section.

In addition, referring to FIG. 6, the right lead cross section of the coil part 200 may have a taper shape of which a width is reduced from the top toward the bottom. Although not illustrated in FIG. 6, the left lead cross section of the coil part 200 may also have a taper shape of which a width is reduced from the bottom toward the top. Here, the top and the bottom are defined in relation to the third direction in FIGS. 5 and 6. The reason is that regions other than regions of the support member 230 and the insulating layers 213 and 223 supporting the coil layers 211, 221, 212, and 222 may be selectively removed by a trimming process, or the like, at the time of manufacturing the coil component 10A and the support member 230. In this case, the insulating layers 213 and 223 containing the insulating material may be more removed toward the centers thereof in a removing process. The coil layers 211, 221, 212, and 222 may not be substantially affected. The shape of the lead cross section described above means that the body part 100 is formed by filling a space as much as possible with a magnetic material by the trimming process, or the like, after the coil part 200 of which the number of coil turns (or windings) is increased in a stacking direction is formed by stacking the insulating layers 213 and 223 on the support member 230 and stably forming the second coil layers 212 and 222 on the insulating layers 213 and 223, respectively. Therefore, a coil component may be manufactured in which a risk of a defect such as occurrence of short-circuits between the coil patterns, or the like, is decreased, uniformity of coils and a low DC resistance $R_{dc}$ are secured, and thinness is implemented.

Figure 7:
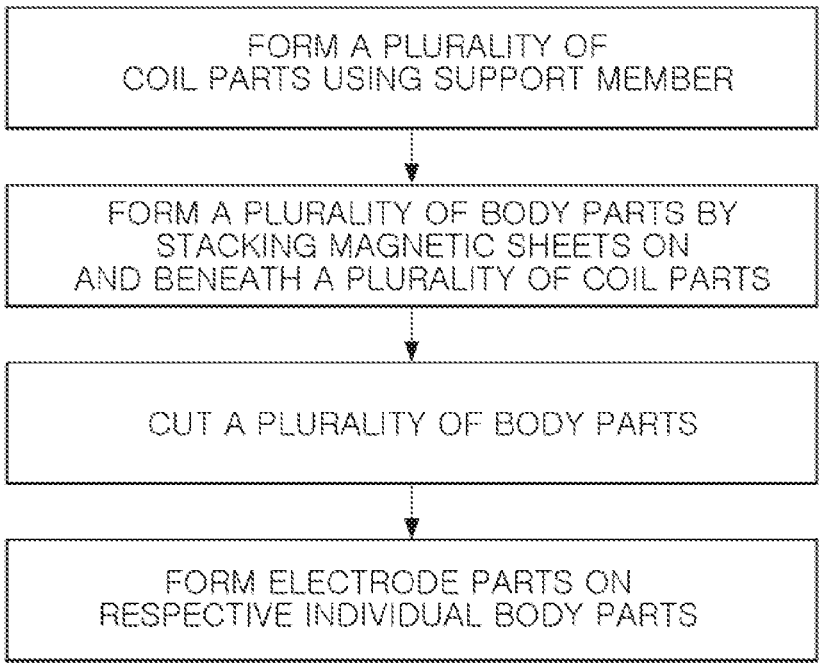
FIG. 7 is a flow chart illustrating an example of a process of manufacturing the coil component of FIG. 2.

FIG. 7 is a flow chart illustrating an example of a process of manufacturing the coil component of FIG. 2.

Referring to FIG. 7, the coil component 10A according to an example may be manufactured by forming a plurality of coil parts 200 using the support member 230, forming a plurality of body parts 100 by stacking magnetic sheets on and beneath the plurality of coil parts 200, cutting the plurality of body parts 100, and forming the electrode parts 300 on the respective individual body parts 100 as an example.

When the support member 230 is used, the plurality of coil parts 200 may be simultaneously formed, and the plurality of body parts 100 may be simultaneously formed using the plurality of coil parts 200. Then, a plurality of coil components may be simultaneously manufactured by a singulation process such as a dicing process, or the like. That is, the process of manufacturing the coil component described above may be advantageous in mass production. The plurality of coil parts 200 may be formed using one surface or two opposing surfaces of the support member 230. In a case in which the plurality of coil parts 200 are formed using two opposing surfaces of the support member 230, the vias 234 may be formed by forming through-holes penetrating through the support member 230 by a method such as mechanical drilling, laser drilling, or the like, and then filling the through-holes by plating. A more detailed description for a method of forming the coil part 200 will be provided below.

The plurality of body parts 100 may be formed by stacking, compressing, and hardening the magnetic sheets on and beneath the plurality of coil parts 200 after the plurality of coil parts 200 are formed. The magnetic sheets may contain the magnetic material as described above, and may be manufactured in a sheet shape by mixing magnetic metal particles, a binder resin, a solvent, and the like, with each other to prepare slurry and applying and then drying the slurry at a thickness of several ten micrometers (e.g., 10, 20, 50, or 90 micrometers) on a carrier film by a doctor blade method.

The electrode part 300 may be formed by forming the external electrodes 301 and 302 on the outer surfaces of the body part 100 so as to be connected to a respective lead cross section of the coil part 200 exposed to respective surfaces of the body part 100. The external electrodes 301 and 302 may be formed of a paste containing a metal having excellent electrical conductivity, for example, a conductive paste containing nickel (Ni), copper (Cu), tin (Sn), or silver (Ag), or alloys thereof, or the like In addition, the external electrodes 301 and 302 may further include a plating layer formed on the paste layer. The plating layer may contain one or more selected from the group consisting of nickel (Ni), copper (Cu), and tin (Sn). For example, a nickel (Ni) layer and a tin (Sn) layer may be sequentially formed in the plating layer.

FIGS. 8A through 8F are schematic views illustrating examples of process steps for forming a coil part of FIG. 3.

FIGS. 9A through 9F are schematic views illustrating examples of process steps for forming a coil part of FIG. 5.

Figure 8A:
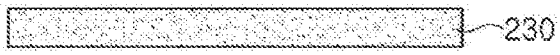
FIGS. 8A through 8F are schematic views illustrating examples of process steps for forming a coil part of FIG. 3.
Figure 9A:
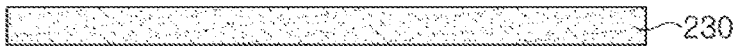
FIGS. 9A through 9F are schematic views illustrating examples of process steps for forming a coil part of FIG. 5.

Referring to FIGS. 8A and 9A, the support member 230 may be prepared. A material or a kind of the support member 230 is not particularly limited as long as the support member 230 may support the coil layers 211, 212, 221, and 222, as described above. The support member 230 may have two opposing surfaces each having a wide area so that the plurality of coil parts 200 may be formed for the purpose of mass production. Metal layers (not illustrated) used as seed layers to form the first coil layers 211 and 221 may be formed on the support layer 230. That is, the support member 230 may be a copper clad laminate (CCL).

Figure 8B:
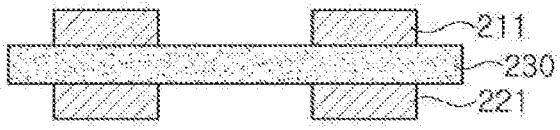
Figure 9B:
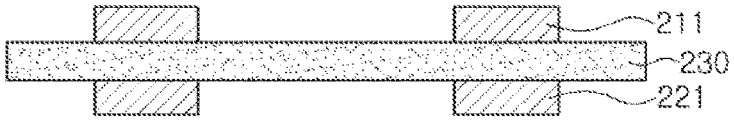

Referring to FIGS. 8B and 9B, the first coil layers 211 and 221 may be formed on the two opposing surfaces of the support member 230, respectively. A method of forming the first coil layers 211 and 221 is not particularly limited, but may a photolithography method and plating method. For example, in the photolithography method, exposure and development using a photo-resist may be used. In addition, in the plating method, electrolytic copper plating, electroless copper plating, or the like, may be used. In more detail, the plating method may be a plating method using a method such as chemical vapor deposition (CVD), physical vapor deposition (PVD), sputtering, a subtractive process, an additive process, a semi-additive process (SAP), a modified semi-additive process (MSAP), or the like, but is not limited thereto. Meanwhile, although not illustrated in FIGS. 8B and 9B, the via 234 may be formed by forming the through-hole penetrating through the support member 230 by a method such as mechanical drilling, laser drilling, or the like, and then filling the through-hole by plating, at the time of forming the first coil layers 211 and 221, and the first coil layers 211 and 221 each disposed on the opposing surfaces of the support member 230, that is, the first coil layer 211 disposed in the upper portion and the first coil layer 221 disposed in the lower portion may be electrically connected to each other through the via 234. Here, the upper portion and the lower portion are defined in relation to the third direction of the drawings.

Figure 8C:
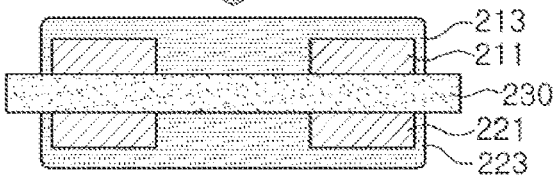
Figure 9C:
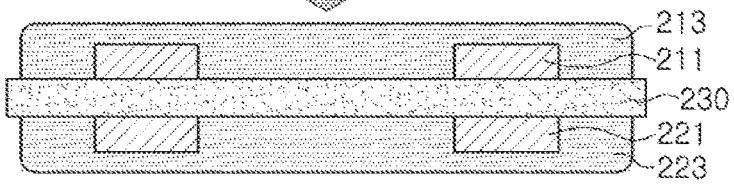

Referring to FIGS. 8C and 9C, the insulating layers 213 and 223 may be stacked on the two opposing surfaces of the support member 230 so as to cover the first coil layers 211 and 221, respectively. A method of forming the insulating layers 213 and 223 is not particularly limited. For example, the insulating layers 213 and 223 may be formed by a method of laminating precursor films containing the insulating material described above on the support member 230 on which the first coil layers 211 and 221 are formed and then hardening the precursor films. Alternatively, the insulating layers 213 and 223 may be formed by a method of applying the insulating material described above onto the support member 230 on which the first coil layers 211 and 221 are formed and then hardening the insulating material. As the method of laminating the precursor film, for example, a method of performing a hot press process of pressing the precursor film for a predetermined time at a high temperature, decompressing the precursor film, and then cooling the precursor film to a room temperature, cooling the precursor film in a cold press process, and then separating a work tool, or the like, may be used. As the method of applying the insulating material, for example, a screen printing method of applying ink by squeeze, a spray printing method of applying ink in a mist form, or the like, may be used.

Figure 8D:
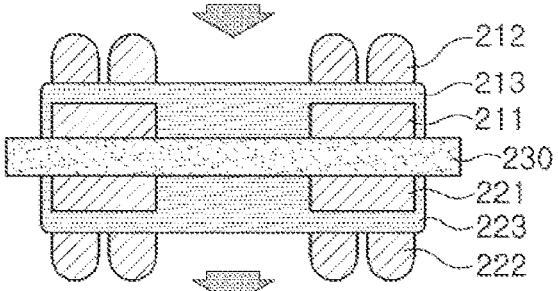
Figure 9D:
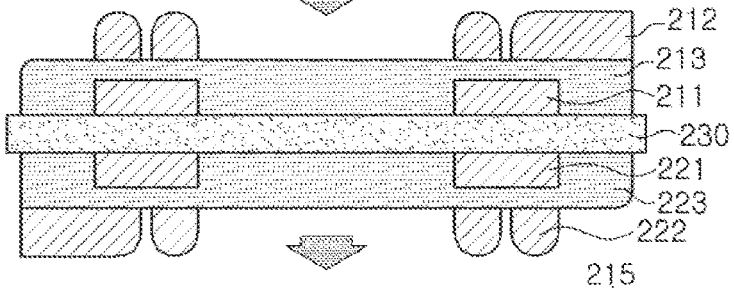

Referring to FIGS. 8D and 9D, the second coil layers 212 and 222 may be formed on the insulating layers 213 and 223, respectively. A method of forming the second coil layers 212 and 222 is also not particularly limited, but may be a photolithography method and a plating method as described above. Meanwhile, although not illustrated in FIGS. 8D and 9D, the vias 214 and 224 may be formed by forming through-holes each penetrating through the insulating layers 213 and 223 by a method such as a photolithography method, mechanical drilling, laser drilling, or the like, and then filling the through-holes by plating, at the time of forming the second coil layers 212 and 222, and the first coil layers 211 and 221 and the second coil layers 212 and 222 may be electrically connected to each other through the vias 214 and 224, respectively.

Figure 8E:
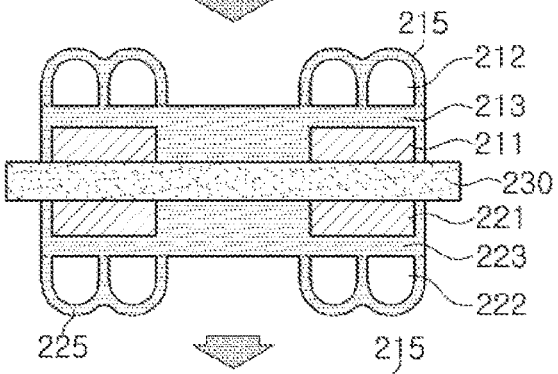
Figure 9E:
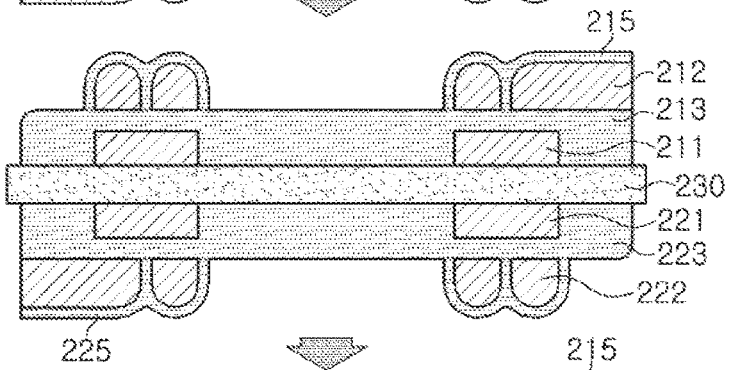

Referring to FIGS. 8E and 9E, the insulating films 215 and 225 each covering the second coil layers 212 and 222 may be formed. A method of forming the insulating films 215 and 225 is not particularly limited, but may be a coating method. The insulating films 215 and 225 may contain the same material as that of the insulating layers 213 and 223. In this case, the insulating films 215 and 225 may be integrated with the insulating layers 213 and 223, respectively, after being hardened, but are not limited thereto.

Figure 8F:
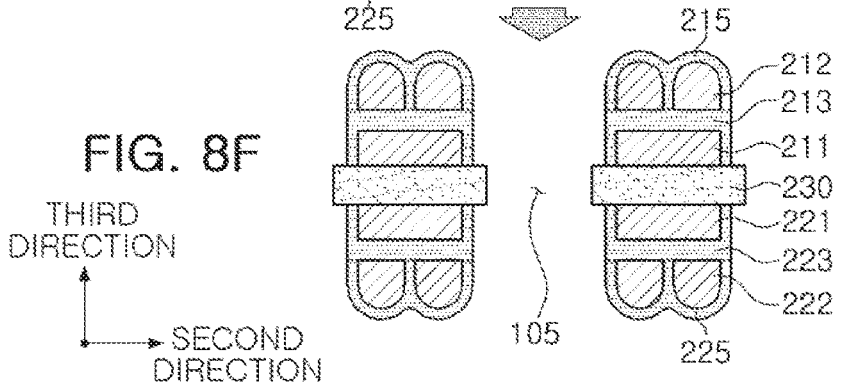
Figure 9F:
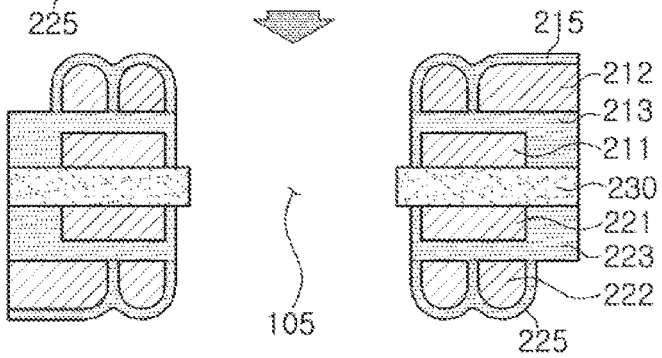

Referring to FIGS. 8F and 9F, regions other than regions of the coil part 200 in which the coil layers 211, 212, 221, and 222 are formed may be selectively removed using a trimming method, or the like. In this process, a central portion of the coil part 200 is removed, such that the through-hole 105 may be formed. Then, the body part 100 in which the coil part 200 is accommodated may be formed by stacking the magnetic sheets, or the like, and individual body parts 100 in which the coil parts 200 are formed may be formed when singulation is performed on the body part 100 using the dicing process, or the like. Results of the trimming and dicing processes are partially reflected in FIGS. 8F and 9F, but the magnetic material, that is, the body part 100 is not illustrated.

Figure 10:
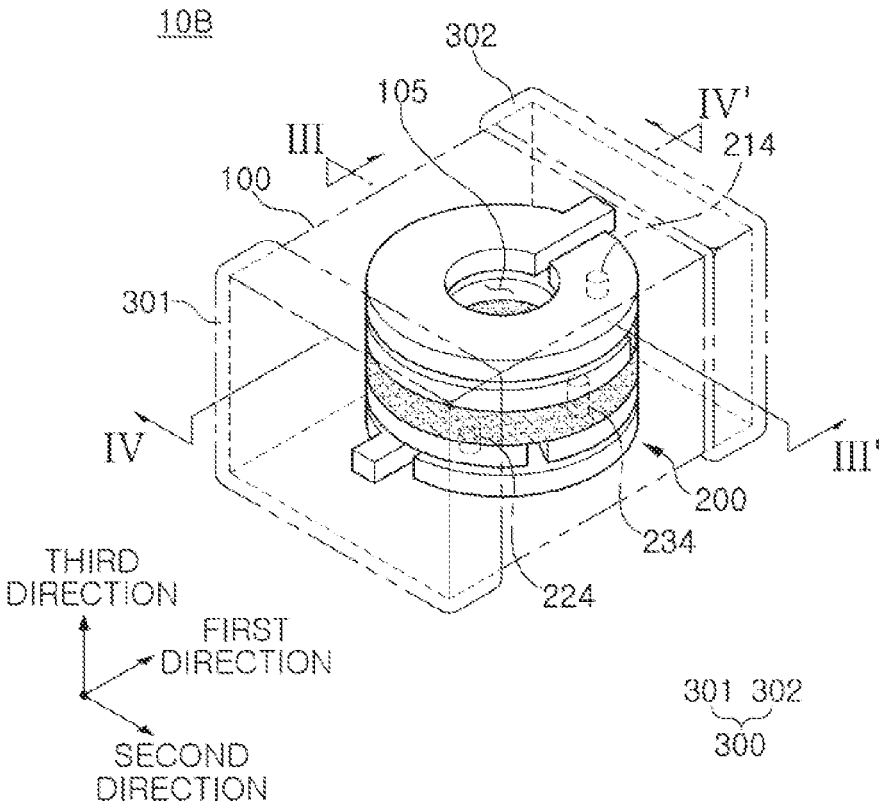
FIG. 10 is a schematic perspective view illustrating another example of a coil component.

FIG. 10 is a schematic perspective view illustrating another example of a coil component.

Figure 11:
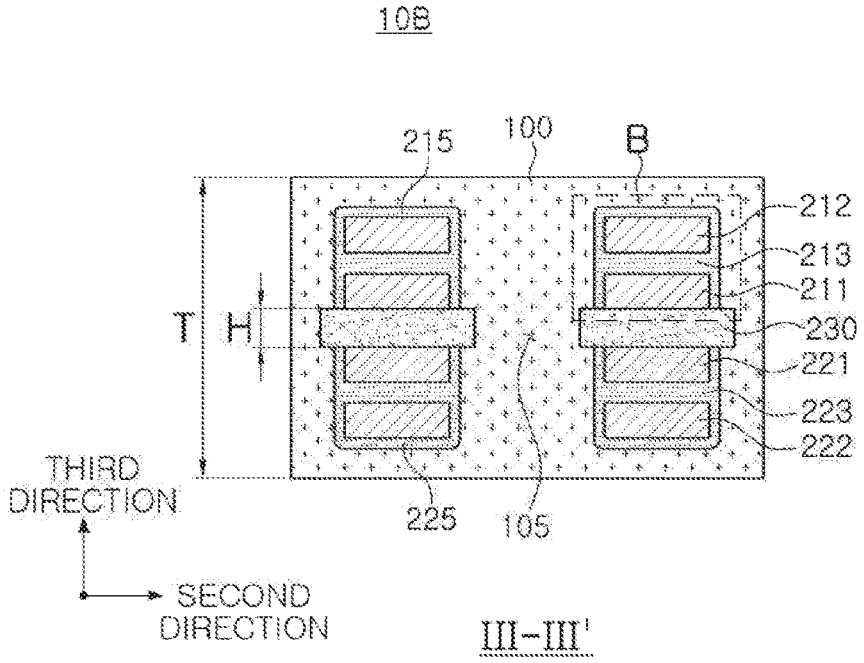
FIG. 11 is a schematic cross-sectional view of the coil component of FIG. 10 taken along line III-III'.

FIG. 11 is a schematic cross-sectional view of the coil component of FIG. 10 taken along line III-III'.

Figure 12:
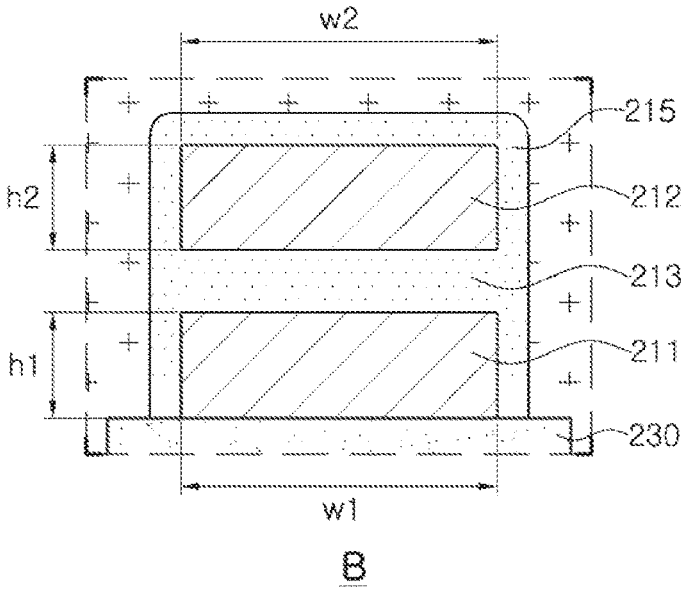
FIG. 12 is a schematic enlarged cross-sectional view of region B of the coil component of FIG. 11.

FIG. 12 is a schematic enlarged cross-sectional view of region B of the coil component of FIG. 11.

Referring to FIGS. 10 through 12, a coil component 10B according to another example may also have a structure in which a coil part 200 is disposed in a body part 100 containing a magnetic material. An electrode part 300 electrically connected to the coil part 200 may be disposed on an outer surface of the body part 100. The coil part 200 may include a support member 230 and a plurality of coil layers 211, 212, 221, and 222 disposed on both surfaces of the support member 230. Insulating layers 213 and 223 disposed on both surfaces of the support member 230 and each covering a corresponding one of first coil layers 211 and 221 formed in an inner portion may be disposed between first and second coil layers 211 and 212 formed in an upper portion and between first and second coil layers 221 and 222 formed in a lower portion, respectively. The first coil layer 211 disposed in the upper portion and the first coil layer 221 disposed in the lower portion, which are disposed on opposing surfaces of the support member 230, may be electrically connected to each other by a via 234 penetrating through the support member 230. The first and second coil layers 211 and 212 disposed in the upper portion and the first and second coil layers 221 and 222 disposed in the lower portion may be electrically connected to each other through vias 214 and 224 each penetrating through the corresponding insulating layer 213 and 223, respectively. Hereinafter, components of the coil component 10B according to another example will be described in more detail. However, contents overlapped with the contents described above will be omitted, and contents different from the contents described above will be mainly described.

Cross sections of the conductors of the coil patterns of the first coil layers 211 and 221 may have an aspect ratio (AR), which is a ratio ($h_1/w_1$) of a thickness $h_1$ to a width $w_1$, less than 1 (where $h_1$ is measured orthogonally to the opposing surfaces of the support member 230 on which the first coil layers 211 and 221 are disposed, and $w_1$ is measured parallel to the opposing surfaces). Cross sections of the conductors of the coil patterns of the second coil layers 212 and 222 may also have an aspect ratio (AR), which is a ratio ($h_2/w_2$) of a thickness $h_2$ to a width $w_2$, less than 1 (where $h_2$ is measured orthogonally to the opposing surfaces of the support member 230 on which the first coil layers 211 and 221 are disposed, and $w_2$ is measured parallel to the opposing surfaces). That is, in the coil component 10B according to another example, coil pattern conductors of the coil layers 211, 212, 221, and 222 may have an aspect ratio less than 1. For example, the coil pattern conductors of the first coil layers 211 and 221 may have a width $w_1$ of about 160 μm to 190 μm and a thickness $h_1$ of about 60 μm to 90 μm, and the coil pattern conductors of the second coil layers 212 and 222 may have a width $w_2$ of about 160 μm to 190 μm and a thickness $h_2$ of about 60 μm to 90 μm.

In a case in which the aspect ratios of the coil pattern conductors of the coil layers 211, 212, 221, and 222 are less than 1, a height and a width of the coil patterns may be freely adjusted within a dispersion allowed by a process technology of forming coil patterns such that uniformity of the coil patterns may be excellent. Additionally, the coil pattern conductors are wide in the width direction such that a cross-sectional area of the coil part is increased, whereby low DC resistance $R_{dc}$ characteristics may be provided. In addition, since an interval between the coil pattern turns or windings does not need to be forcibly adjusted, the probability of occurrence of a defect such as short-circuits between the coil patterns, or the like, may be decreased. In addition, since the coil layers 211, 212, 221, and 222 may have the same rotation direction and may be electrically connected to each other through the vias 214, 224, and 234, the number of turns (or windings) of the coils in a stacking direction may be increased. Here, the stacking direction refers to the third direction in the drawings.

In addition, since the aspect ratios of all the coil pattern conductors of the coil layers 211, 212, 221, and 222 are less than 1, a thickness of the coil part (measured orthogonally to the opposing surfaces of the support member 230 on which the coil layers 211 and 221 are disposed) may be basically thin. Here, in order to have a sufficient number of turns (or windings) in the coil component 10B, the respective coil layers 211, 221, 212, and 222 may be formed to utilize spaces as much as possible in the horizontal directions, that is in the first direction and/or the second direction (e.g., directions parallel to the opposing surfaces of the support member 230 on which the coil layers 211 and 221 are disposed). That is, the first coil layers 211 and 221 and the second coil layers 212 and 222 stacked in the vertical direction may have overlapped regions. Therefore, a coil component that is thin and has sufficient coil characteristics may be implemented.

Conductors of the coil patterns of the first coil layers 211 and 221 may have an aspect ratio (AR), which is a ratio ($h_1/w_1$) of a thickness $h_1$ to a width $w_1$, less than 1. In addition, the coil patterns of the first coil layers 211 and 221 may each include only a single turn (or winding). Here, the single turn (or winding) may indicate that the number of turns (or windings) is 1 or less. Therefore, a risk of occurrence of a defect such as short-circuits between the coil patterns, or the like, may be decreased, and uniformity of coils and a low DC resistance $R_{dc}$ may be provided. A conductive material such as copper (Cu), aluminum (Al), silver (Ag), tin (Sn), gold (Au), nickel (Ni), lead (Pd), or alloys thereof, or the like, may be used as materials of the first coil layers 211 and 221.

Conductors of the coil patterns of the second coil layers 212 and 222 may also have an aspect ratio (AR), which is a ratio ($h_2/w_2$) of a thickness $h_2$ to a width $w_2$, less than 1. In addition, the coil patterns of the second coil layers 212 and 222 may each include only a single turn (or winding). Here, the single turn (or winding) may indicate that the number of turns (or windings) is 1 or less. Therefore, a risk of occurrence of a defect such as short-circuits between the coil patterns, or the like, may be decreased, and uniformity of coils and a low DC resistance $R_{dc}$ may be provided. A conductive material such as copper (Cu), aluminum (Al), silver (Ag), tin (Sn), gold (Au), nickel (Ni), lead (Pd), or alloys thereof, or the like, may be used as materials of the second coil layers 212 and 222.

Only the first coil layers 211 and 221 and the second coil layers 212 and 222 are illustrated in the drawings, but additional coil layers may be additionally formed on the second coil layers 212 and 222, and insulating layers in which vias are formed may be disposed between the additional coil layers and the second coil layers 212 and 222, such that the additional coil layers and the second coil layers 212 and 222 may be electrically connected to each other. In this case, the additional coil layers may have the same contents as the first coil layers 211 and 221 or the second coil layers 212 and 222. In addition, additional coil layers may be further formed between the first coil layers 211 and 221 and the second coil layers 212 and 222, and insulating layers in which vias are formed may be disposed between the additional coil layers and the first coil layers 211 and 221 or the second coil layers 212 and 222, such that the additional coil layers and the first coil layers 211 and 221 or the second coil layers 212 and 222 may be electrically connected to each other. In this case, the additional coil layers may have the same contents as the first coil layers 211 and 221 or the second coil layers 212 and 222.

Figure 13:
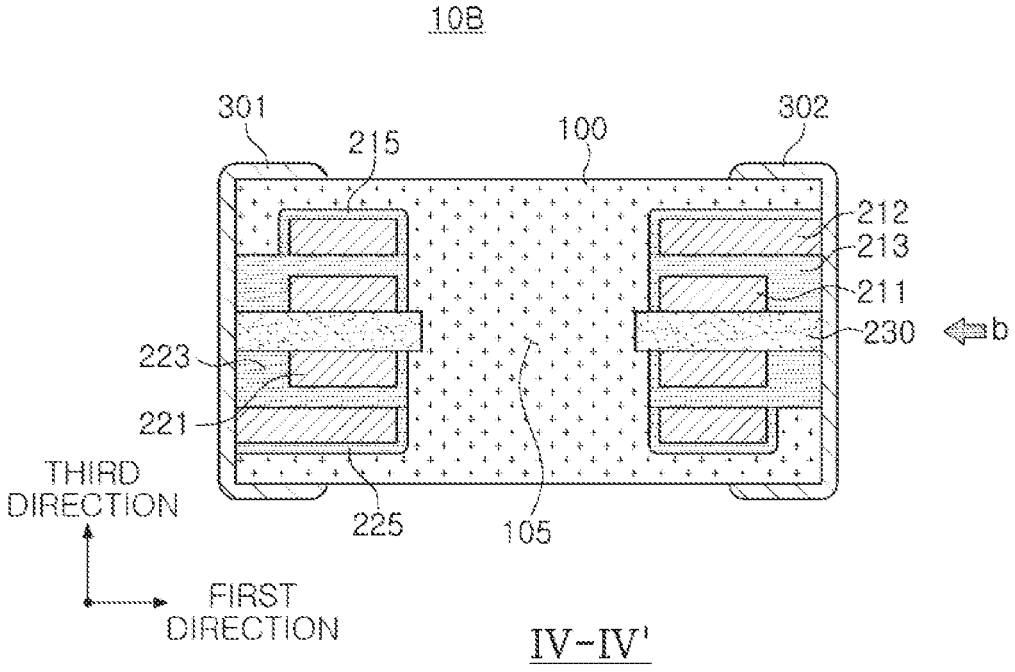
FIG. 13 is a schematic cross-sectional view of the coil component of FIG. 10 taken along line IV-IV'.

FIG. 13 is a schematic cross-sectional view of the coil component 10B of FIG. 10 taken along line IV-IV'.

Figure 14:
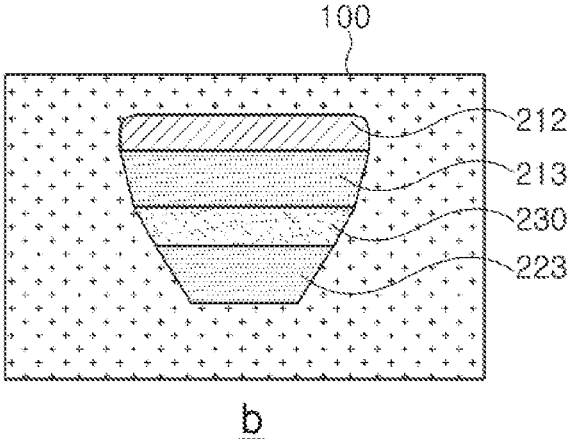
FIG. 14 is a schematic cross-sectional view of a body part of the coil component of FIG. 13 viewed in direction b.

FIG. 14 is a schematic cross-sectional view of a body part of the coil component 10B of FIG. 13 viewed in direction b.

Referring to FIGS. 13 and 14, also in the coil component 10B according to another example, lead terminals of coil patterns led in order to be connected to the external electrodes 301 and 302 may be supported by the support member 230 and the insulating layers 213 and 223. Therefore, the lead terminals of the coil patterns may be stably formed, and may have excellent connection force to the external electrodes 301 and 302. Meanwhile, although the insulating film 215 is omitted in FIG. 14, the insulating film 215 may also be led. Alternatively, the insulating film 215 may also not substantially remain in the lead cross section.

In addition, referring to FIGS. 13 and 14, also in the coil component 10B according to the other example, the right lead cross section of the coil part 200 may have a taper shape in which a width is reduced from the top toward the bottom of the lead (e.g., in a direction from the coil layer 212 toward the support member 230). Although not illustrated in FIGS. 13 and 14, the left lead cross section of the coil part 200 may also have a taper shape of which a width is reduced from the bottom toward the top (e.g., in a direction from the coil layer 222 toward the support member 230). Here, the top and the bottom directions are defined in relation to the third direction shown in FIG. 14. That is, in accordance with the foregoing, a coil component may be manufactured in which a risk of a defect such as occurrence of short-circuits between the coil patterns, or the like, is decreased, uniformity of coils and a low DC resistance $R_{dc}$ are secured, and thinness is implemented.

Figure 15:
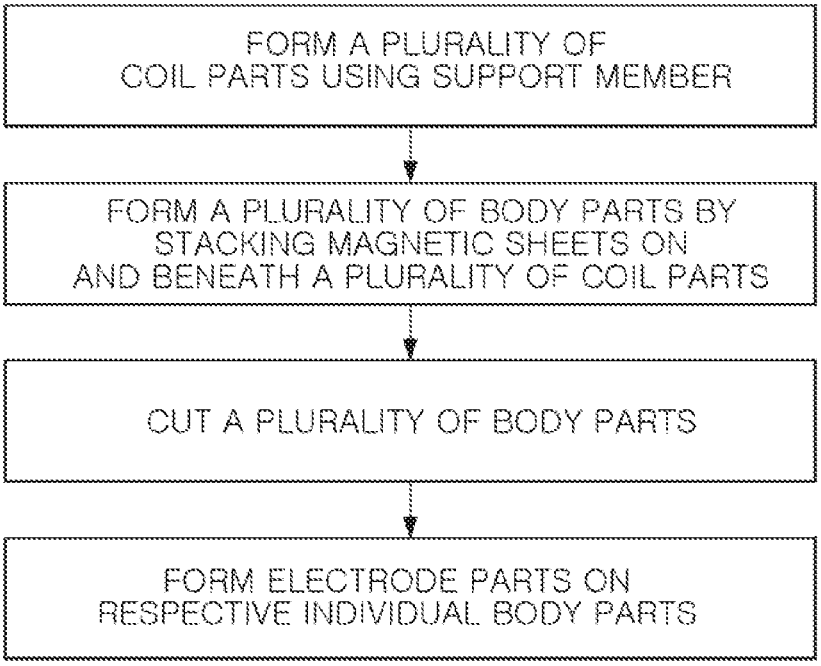
FIG. 15 is a flow chart illustrating an example of a process of manufacturing the coil component of FIG. 10.

FIG. 15 is a flow chart illustrating an example of a process of manufacturing the coil component 10B of FIG. 10.

Referring to FIG. 15, the coil component 10B according to the other example may be manufactured by forming a plurality of coil parts 200 using the support member 230, forming a plurality of body parts 100 by stacking magnetic sheets on and beneath the plurality of coil parts 200, cutting the plurality of body parts 100, and forming the electrode parts 300 on the respective individual body parts 100 as an example. Since descriptions are the same as described above, a description thereof will be omitted.

FIGS. 16A through 16F are schematic views illustrating examples of process steps for forming a coil part of FIG. 11.

FIGS. 17A through 17F are schematic views illustrating examples of process steps for forming a coil part of FIG. 13.

Figure 16A:
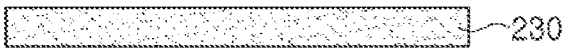
FIGS. 16A through 16F are schematic views illustrating examples of process steps for forming a coil part of FIG. 11.
Figure 17A:
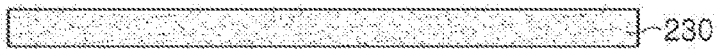
FIGS. 17A through 17F are schematic views illustrating examples of process steps for forming a coil part of FIG. 13.

Referring to FIGS. 16A and 17A, the support member 230 may be prepared. Since descriptions are the same as described above in relation to FIGS. 8A and 9A, a description thereof will be omitted.

Figure 16B:
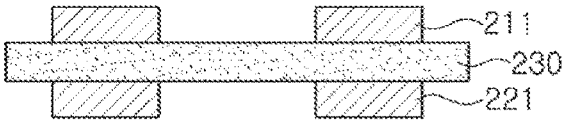
Figure 17B:
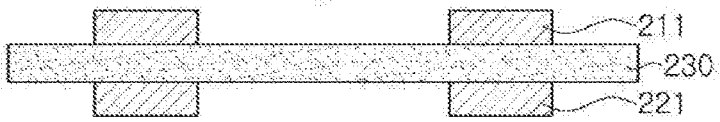

Referring to FIGS. 16B and 17B, the first coil layers 211 and 221 may be formed on both opposing surfaces (e.g., upper and lower surfaces) of the support member 230, respectively. The first coil layers 211 and 221 may be formed so that aspect ratios of the coil patterns thereof are less than 1, as described above. When the first coil layers 211 and 221 are formed, the via 234 penetrating through the support member 230 may be formed, and the first coil layers 211 and 221 respectively formed on surfaces of the support member 230 may be electrically connected to each other through the via 234. Since descriptions are the same as described above in relation to FIGS. 8B and 9B, a description thereof will be omitted.

Figure 16C:
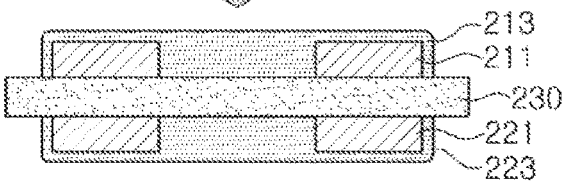
Figure 17C:
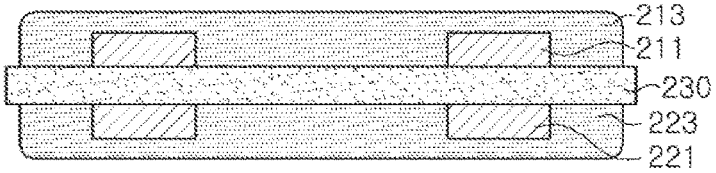

Referring to FIGS. 16C and 17C, the insulating layers 213 and 223 may be stacked on both surfaces of the support member 230, respectively, so as to cover the first coil layers 211 and 221, respectively. Since descriptions are the same as described above in relation to FIGS. 8C and 9C, a description thereof will be omitted.

Figure 16D:
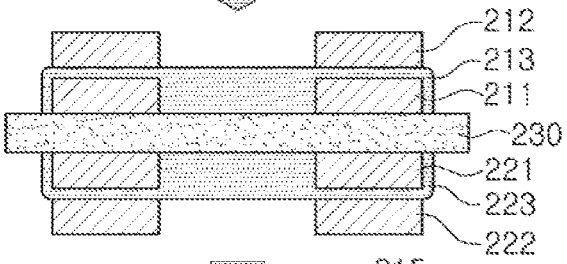
Figure 17D:
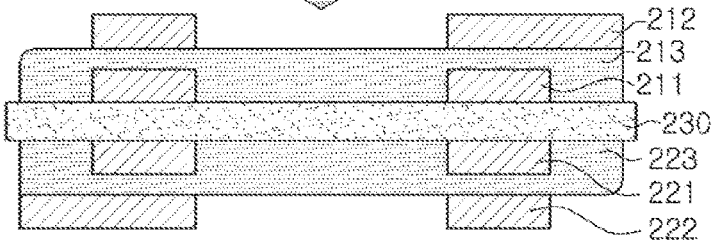

Referring to FIGS. 16D and 17D, the second coil layers 212 and 222 may be formed on the insulating layers 213 and 223, respectively. The second coil layers 212 and 222 may also be formed so that aspect ratios of the coil patterns thereof are less than 1, as described above. When the second coil layers 212 and 222 are formed, the vias 214 and 224 each penetrating through first insulating materials 213 and 223 may be formed, and the first coil layers 211 and 221 and the second coil layers 212 and 222 may be electrically connected to each other through the vias 214 and 224. Since descriptions are the same as described above in relation to FIGS. 8D and 9D, a description thereof will be omitted.

Figure 16E:
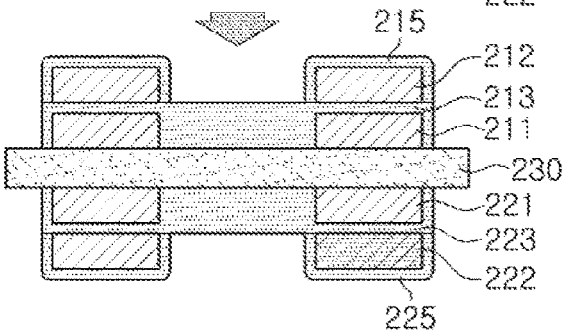
Figure 17E:
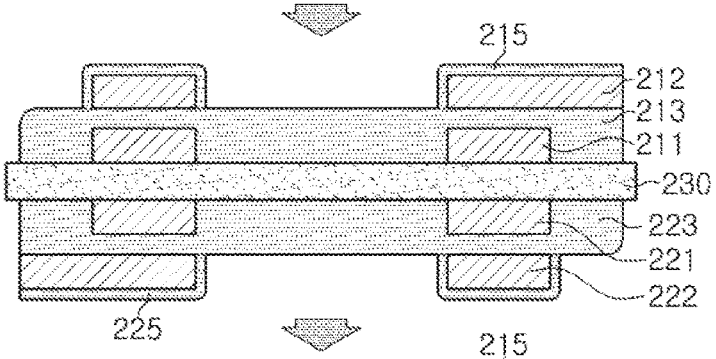

Referring to FIGS. 16E and 17E, the insulating films 215 and 225 each covering the second coil layers 212 and 222 may be formed. Since descriptions are the same as described above in relation to FIGS. 8E and 9E, a description thereof will be omitted.

Figure 16F:
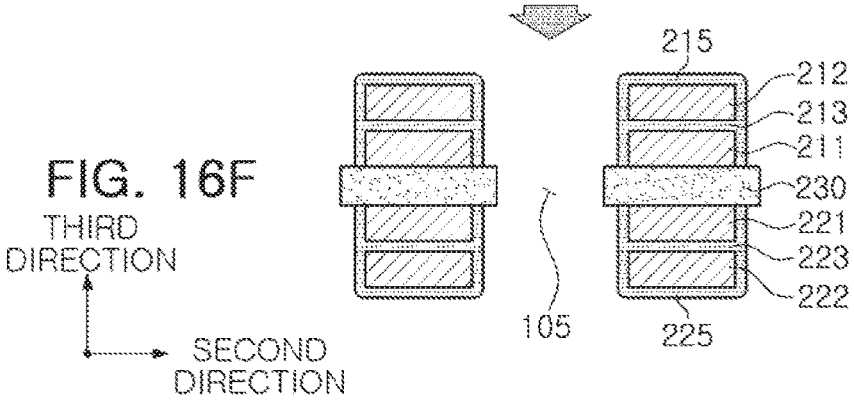
Figure 17F:
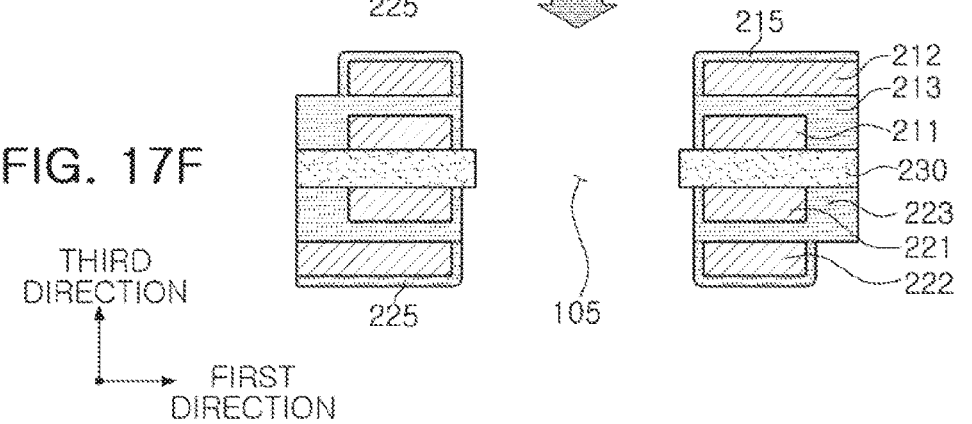

Referring to FIGS. 16F and 17F, selected regions of the coil part 200 may be removed, including regions other than regions of the coil part 200 in which the coil layers 211, 212, 221, and 222 are formed. The selected regions may be selectively removed using a trimming method, dicing method, or the like. Results of the trimming and dicing processes are partially reflected in FIGS. 16F and 17F, but the magnetic material, that is, the body part 100 is not illustrated. Since descriptions are the same as described above in relation to FIGS. 8F and 9F, a description thereof will be omitted.

Figure 18:
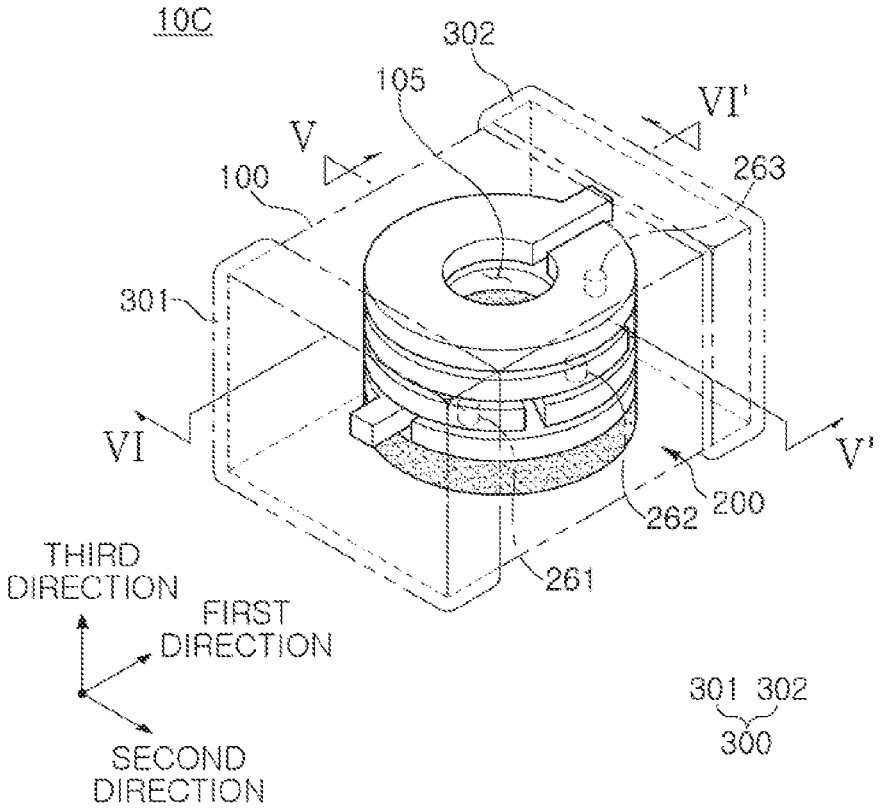
FIG. 18 is a schematic perspective view illustrating another example of a coil component.

FIG. 18 is a schematic perspective view illustrating another example of a coil component 10C.

Figure 19:
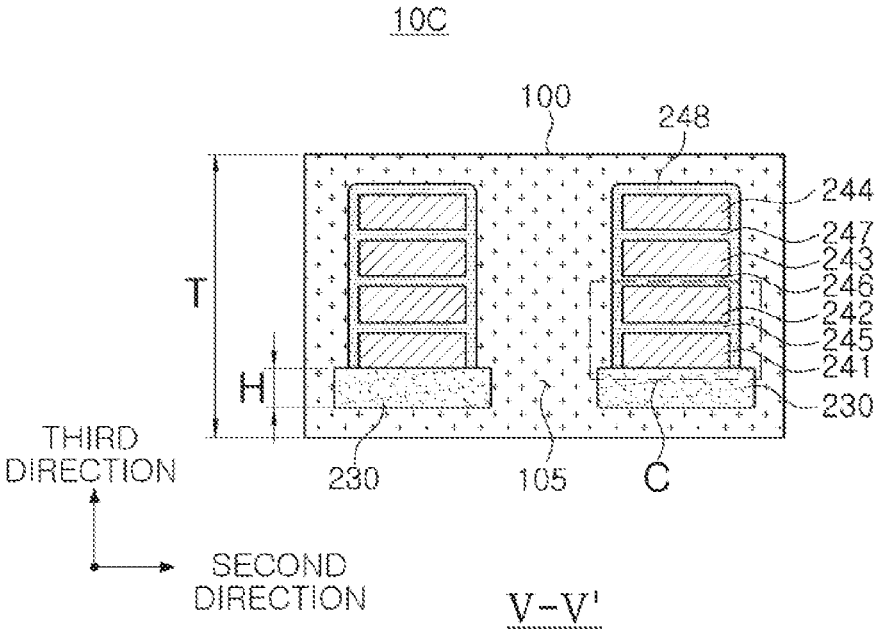
FIG. 19 is a schematic cross-sectional view of the coil component of FIG. 18 taken along line V-V'.

FIG. 19 is a schematic cross-sectional view of the coil component 10C of FIG. 18 taken along line V-V'.

Figure 20:
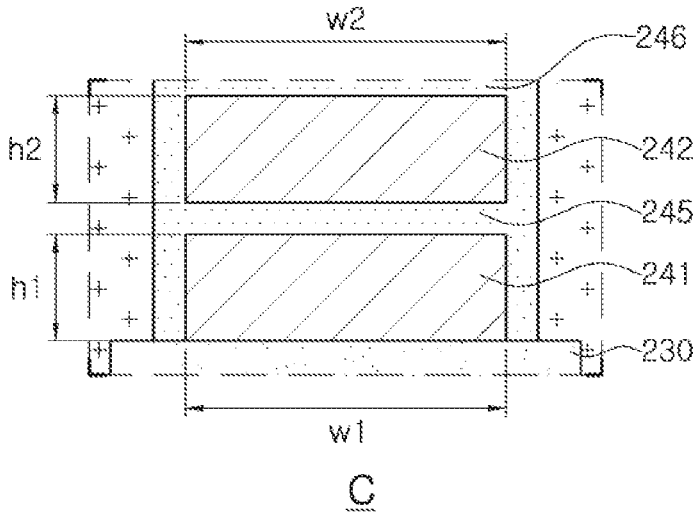
FIG. 20 is a schematic enlarged cross-sectional view of region C of the coil component of FIG. 19.

FIG. 20 is a schematic enlarged cross-sectional view of region C of the coil component 10C of FIG. 19.

Referring to FIGS. 18 through 20, a coil component 10C according to another example may also have a structure in which a coil part 200 is disposed in a body part 100 containing a magnetic material. An electrode part 300 electrically connected to the coil part 200 may be disposed on an outer surface of the body part 100. The coil part 200 may include a support member 230 and a plurality of coil layers 241, 242, 243, and 244 stacked in the third direction on one surface of the support member 230. Insulating layers 245, 246, and 247 each covering the coil layers 241, 242, and 243 may be disposed, respectively, between the plurality of coil layers 241, 242, 243, and 244 stacked in the third direction on one surface of the support member 230. That is, the plurality of coil layers 241, 242, 243, and 244 may be disposed on only one surface of the support member 230. The plurality of coil layers 241, 242, 243, and 244 may be electrically connected to each other through vias 261, 262, and 263 each penetrating through the insulating layers 245, 246, and 247, respectively. Hereinafter, components of the coil component 10C according to another example will be described in more detail. However, contents overlapped with the contents described above will be omitted, and contents different from the contents described above will be mainly described.

The coil part 200 may include a first coil layer 241, a second coil layer 242, a third coil layer 243, and a fourth coil layer 244 sequentially stacked in the third direction on one surface of the support member 230. A first insulating layer 245 covering the first coil layer 241, a second insulating layer 246 covering the second coil layer 242, and a third insulating layer 247 covering the third coil layer 243 may be disposed between the first coil layer 241 and the second coil layer 242, between the second coil layer 242 and the third coil layer 243, and between the third coil layer 243 and the fourth coil layer 244, respectively. The fourth coil layer 244 may be covered by an insulating film 248.

A coil pattern conductor of the first coil layer 241 may have an aspect ratio (AR), which is a ratio ($h_1/w_1$) of a thickness $h_1$ to a width $w_1$, less than 1 (where $h_1$ is measured orthogonally to the surface of the support member 230 on which the first coil layers 241 is disposed, and $w_1$ is measured parallel to the surface of the support member 230). A coil pattern conductor of the second coil layer 242 may also have an aspect ratio (AR), which is a ratio ($h_2/w_2$) of a thickness $h_2$ to a width $w_2$, less than 1 (where $h_2$ is measured orthogonally to the surface of the support member 230 on which the first coil layers 241 is disposed, and $w_2$ is measured parallel to the surface of the support member 230). Likewise, coil pattern conductors of the third coil layer 243 and the fourth coil layer 244 may also have an aspect ratio, which is a ratio of a thickness to a width, less than 1. That is, in the coil component 10C according to another example, coil pattern conductors of the coil layers 241, 242, 243, and 244 may each have an aspect ratio less than 1. In addition, the coil patterns of all the coil layers 241, 242, 243, and 244 may each include a single turn or winding. Here, the single turn or winding may indicate that the number of turns (or windings) is 1 or less.

Therefore, a height and a width of the coil pattern conductors may be freely adjusted within a dispersion allowed by a process technology of forming coil patterns, such that uniformity of the coil patterns may be excellent, and the coil patterns are wide in the width direction, such that a cross-sectional area of the coil part is increased, whereby low DC resistance $R_{dc}$ characteristics may be implemented. In addition, since an interval between the coil pattern turns or windings does not need to be forcibly adjusted, the possibility that a defect such as short-circuits between the coil patterns, or the like, will occur may be decreased. In addition, since the coil layers 241, 242, 243, and 244 may have the same rotation direction and may be electrically connected to each other through the vias 261, 262, and 263, the number of turns of coils in a stacking direction may be increased. Here, the stacking direction refers to the third direction in the drawings.

In addition, since the aspect ratios of all the coil pattern conductors of the coil layers 241, 242, 244, and 244 are less than 1, a thickness of the coil part may basically be thin. Here, in order to have a sufficient number of turns (or windings), the respective coil layers 241, 242, 243, and 244 may be formed to utilize spaces as much as possible in the horizontal directions, that is, the first direction and/or the second direction. That is, overlapped regions may be present between the respective coil layers 241, 242, 243, and 244 stacked in the vertical direction. Therefore, a coil component that is thin and has sufficient coil characteristics may be implemented.

Only the first coil layer 241, the second coil layer 242, the third coil layer 243, and the fourth coil layer 244 are illustrated in the drawings, but additional coil layers may be further formed on the fourth coil layer 244, and an insulating layer in which a via is formed may be disposed between the additional coil layer and the fourth coil layer 244, such that the additional coil layer and the fourth coil layer 244 may be electrically connected to each other. In this case, the additional coil layers may have the same contents as the first coil layer 241, the second coil layer 242, the third coil layer 243, or the fourth coil layer 244.

In addition, additional coil layers may be further formed between the first coil layer 241, the second coil layer 242, the third coil layer 243, and the fourth coil layer 244, and insulating layers in which vias are formed may be disposed between the additional coil layers and the first coil layer 241, the second coil layer 242, the third coil layer 243, and the fourth coil layer 244, such that the additional coil layers and the first coil layer 241, the second coil layer 242, the third coil layer 243, and the fourth coil layer 244 may be electrically connected to each other. In this case, the additional coil layers may have the same contents as the first coil layer 241, the second coil layer 242, the third coil layer 243, or the fourth coil layer 244.

Meanwhile, in some cases, coil patterns of one or more of the first coil layer 241, the second coil layer 242, the third coil layer 243, and the fourth coil layer 244 may have an aspect ratio exceeding 1, as described above in relation to the coil component 10A according to an example, and may have multiple turns. That is, aspects or characteristics of the coil components 10A to 10C may be combined with each other.

Figure 21:
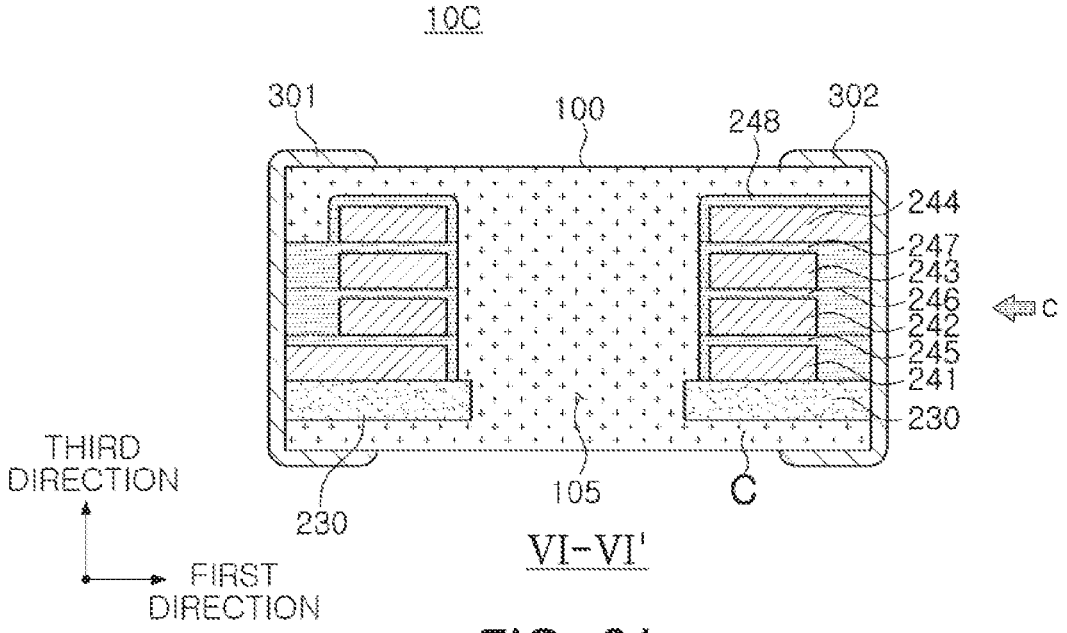
FIG. 21 is a schematic cross-sectional view of the coil component of FIG. 18 taken along line VI-VI'.

FIG. 21 is a schematic cross-sectional view of the coil component 10C of FIG. 18 taken along line VI-VI'.

Figure 22:
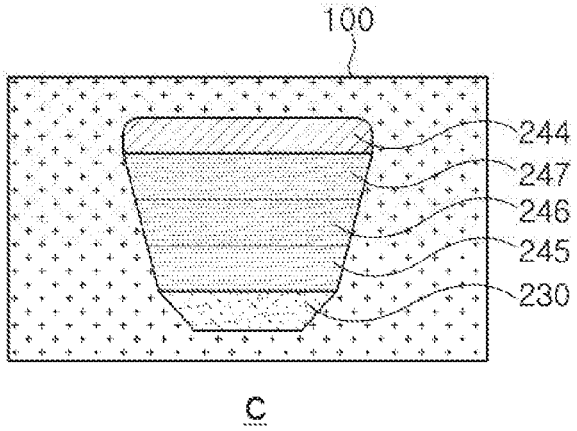
FIG. 22 is a schematic cross-sectional view of a body part of the coil component of FIG. 21 viewed in direction c.

FIG. 22 is a schematic cross-sectional view of a body part of the coil component 10C of FIG. 21 viewed in direction c.

Referring to FIGS. 21 and 22, also in the coil component 10C according to the other example, lead terminals of coil patterns led in order to be connected to the external electrodes 301 and 302 may be supported by the support member 230 and the insulating layers. Therefore, the lead terminals of the coil patterns may be stably formed, and may have excellent connection force to the external electrodes 301 and 302. Meanwhile, although the insulating film 248 is omitted in FIG. 22, the insulating film 248 may also be led. Alternatively, the insulating film 248 may also not substantially remain in the lead cross section.

In addition, referring to FIGS. 21 and 22, also in the coil component 10C according to another example, the right lead cross section of the coil part 200 may have a taper shape of which a width is reduced from the top toward the bottom. That is, a coil component may be manufactured in which a risk of a defect such as occurrence of short-circuits between the coil patterns, or the like, is decreased, uniformity of coils and a low DC resistance $R_{dc}$ are secured, and thinness is implemented. Although not illustrated in FIGS. 21 and 22, also in the left lead cross section of the coil part 200, the insulating layers 245, 246, and 247 disposed above the first coil layer 241 and the support member 230 disposed below the first coil layer 241 may have an approximately taper shape. Here, terms "above" and "below" are defined in relation to the third direction shown in FIG. 21.

Figure 23:
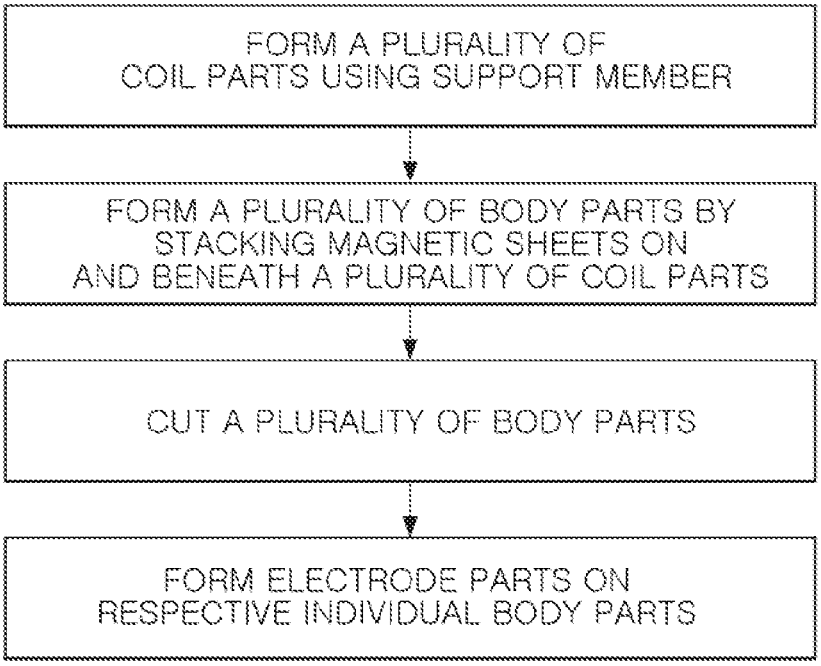
FIG. 23 is a flow chart illustrating an example of a process of manufacturing the coil component of FIG. 18.

FIG. 23 is a flow chart illustrating an example of a process of manufacturing the coil component 10C of FIG. 18.

Referring to FIG. 23, the coil component 10C according to the other example may be manufactured by forming a plurality of coil parts 200 using the support member 230, forming a plurality of body parts 100 by stacking magnetic sheets on and beneath the plurality of coil parts 200, cutting the plurality of body parts 100, and forming the electrode parts 300 on the respective individual body parts 100 as an example. Since descriptions are the same as described above (see, e.g., FIGS. 7 and 15), a description thereof will be omitted.

FIGS. 24A through 24G are schematic views illustrating examples of process steps for forming a coil part of FIG. 19.

FIGS. 25A through 25G are schematic views illustrating examples of process steps for forming a coil part of FIG. 21.

Figure 24A:
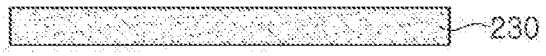
FIGS. 24A through 24G are schematic views illustrating examples of process steps for forming a coil part of FIG. 19.
Figure 25A:
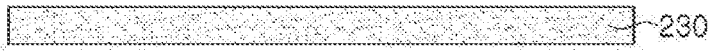
FIGS. 25A through 25G are schematic views illustrating examples of process steps for forming a coil part of FIG. 21.

Referring to FIGS. 24A and 25A, the support member 230 may be prepared. Since descriptions are the same as described above, a description thereof will be omitted.

Figure 24B:
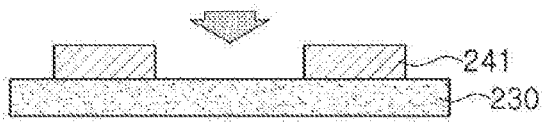
Figure 25B:
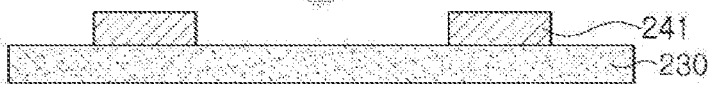

Referring to FIGS. 24B and 25B, the first coil layer 241 may be formed on one surface of the support member 230. The first coil layer 241 may be formed so that an aspect ratio of the coil pattern thereof is less than 1, as described above. Since descriptions are the same as described above, a description thereof will be omitted.

Figure 24C:
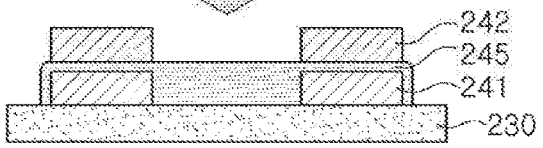
Figure 25C:
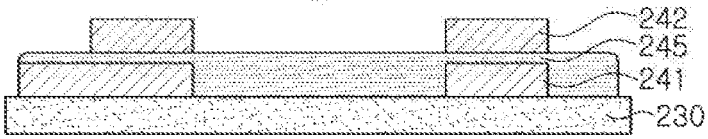

Referring to FIGS. 24C and 25C, the first insulating layer 245 may be stacked on one surface of the support member 230 so as to cover the first coil layer 241. Since descriptions are the same as described above, a description thereof will be omitted. Then, the second coil layer 242 may be formed on the first insulating layer 245. The second coil layer 242 may also be formed so that an aspect ratio of the coil pattern thereof is less than 1, as described above. Since descriptions are the same as described above, a description thereof will be omitted.

Figure 24D:
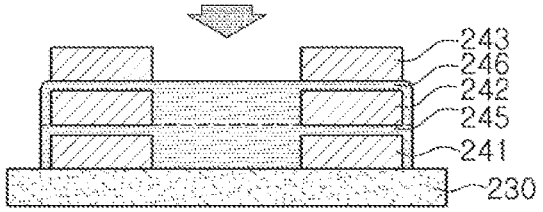
Figure 25D:
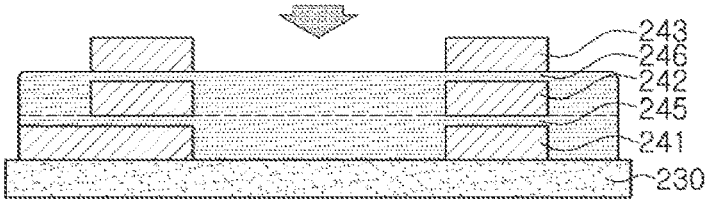

Referring to FIGS. 24D and 25D, the second insulating layer 246 may be stacked on the first insulating layer 245 so as to cover the second coil layer 242. Since descriptions are the same as described above, a description thereof will be omitted. Then, the third coil layer 243 may be formed on the second insulating layer 246. The third coil layer 243 may also be formed so that an aspect ratio of the coil pattern thereof is less than 1, as described above. Since descriptions are the same as described above, a description thereof will be omitted.

Figure 24E:
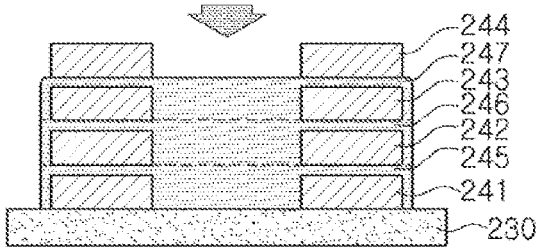
Figure 25E:
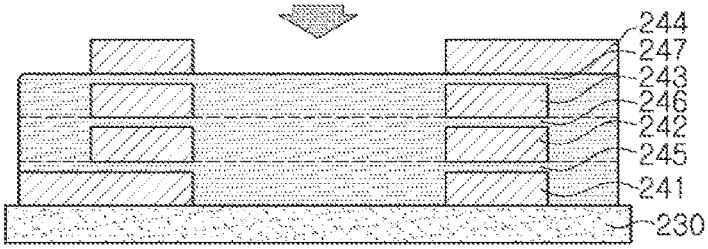

Referring to FIGS. 24E and 25E, the third insulating layer 247 may be stacked on the second insulating layer 246 so as to cover the third coil layer 242. Since descriptions are the same as described above, a description thereof will be omitted. Then, the fourth coil layer 244 may be formed on the third insulating layer 247. The fourth coil layer 244 may also be formed so that an aspect ratio of the coil pattern thereof is less than 1, as described above. Since descriptions are the same as described above, a description thereof will be omitted.

Figure 24F:
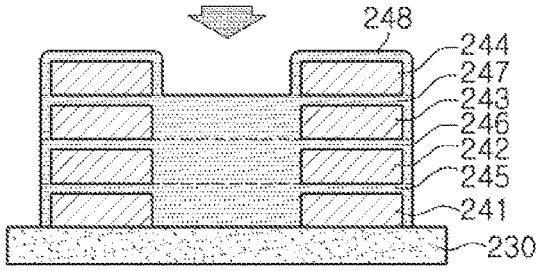
Figure 25F:
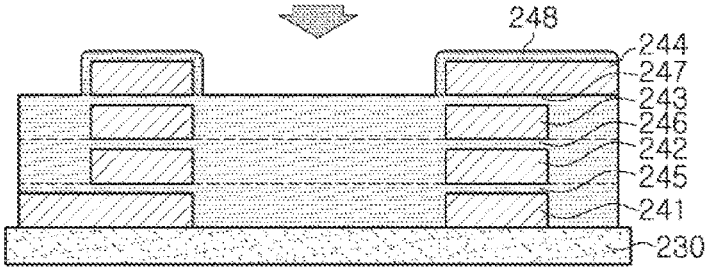

Referring to FIGS. 24F and 25F, the insulating film 248 covering the fourth coil layer 244 may be formed. Since descriptions are the same as described above, a description thereof will be omitted.

Figure 24G:
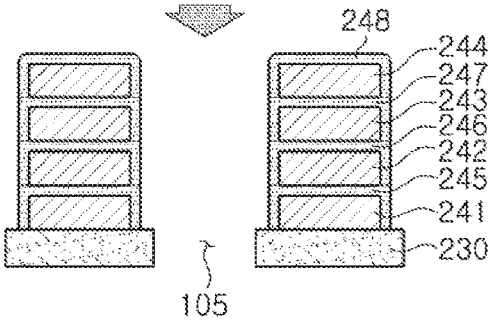
Figure 24G:
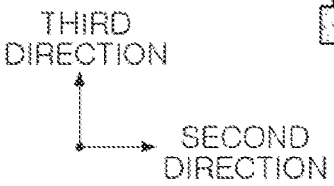
Figure 25G:
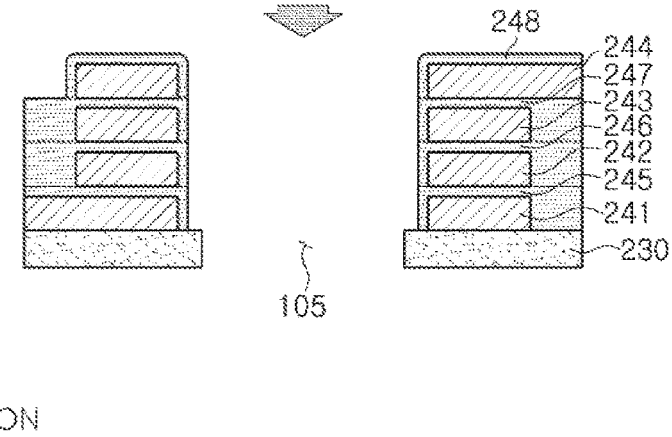

Referring to FIGS. 24G and 25G, regions of the coil part 200 may be selectively removed including regions other than regions of the coil part 200 in which the coil layers 241, 242, 243, and 244 are formed. The regions may be selectively removed using a trimming method, a dicing method, or the like. Results of the trimming and dicing processes are partially reflected in FIGS. 24G and 25G, but the magnetic material, that is, the body part 100 is not illustrated. Since descriptions are the same as described above, a description thereof will be omitted.

Figure 26:
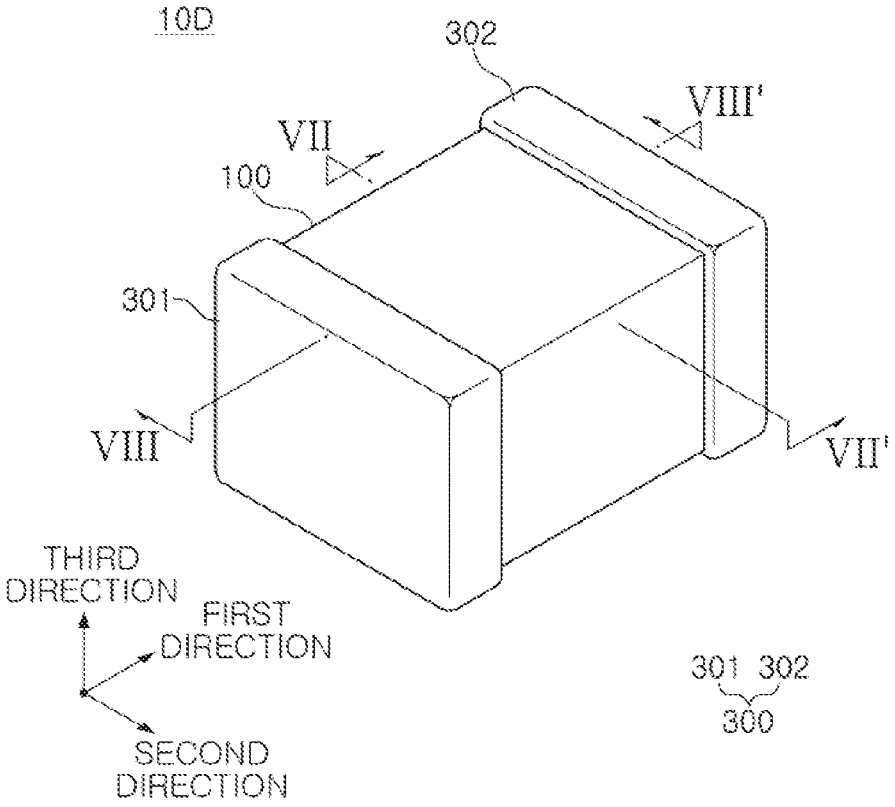
FIG. 26 is a schematic perspective view illustrating another example of a coil component.

FIG. 26 is a schematic perspective view illustrating another example of a coil component 10D.

Figure 27:
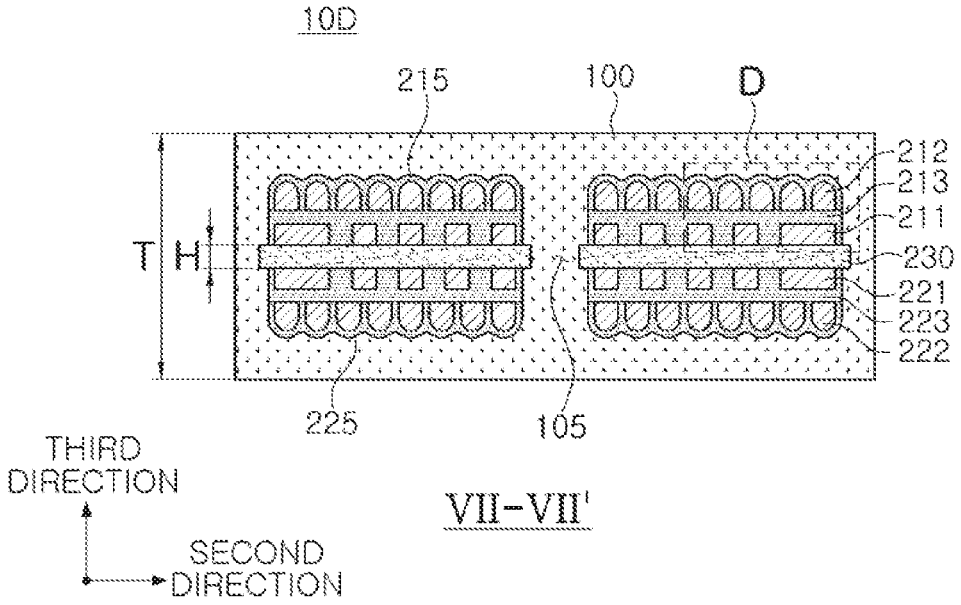
FIG. 27 is a schematic cross-sectional view of the coil component of FIG. 26 taken along line VII-VII'.

FIG. 27 is a schematic cross-sectional view of the coil component 10D of FIG. 26 taken along line VII-VII'.

Figure 28:
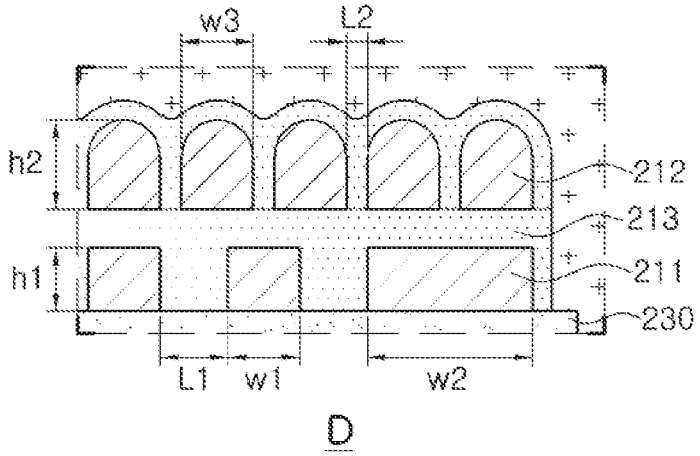
FIG. 28 is a schematic enlarged cross-sectional view of region D of the coil component of FIG. 27.

FIG. 28 is a schematic enlarged cross-sectional view of region D of the coil component 10D of FIG. 27.

Referring to FIGS. 26 through 28, a coil component 10D according to another example may also have a structure in which a coil part 200 is disposed in a body part 100 containing a magnetic material. An electrode part 300 electrically connected to the coil part 200 may be disposed on an outer surface of the body part 100. The coil part 200 may include a support member 230 and a plurality of coil layers 211, 212, 221, and 222 disposed on both surfaces of the support member 230. Insulating layers 213 and 223 are each disposed on a respective surface of the support member 230 and each cover a respective one of first coil layers 211 and 221 formed in an inner portion. The insulating layers 213 and 223 may be disposed between first and second coil layers 211 and 212 formed in an upper portion and between first and second coil layers 221 and 222 formed in a lower portion, respectively. Hereinafter, components of the coil component 10D according to another example will be described in more detail. However, contents overlapped with the contents described above will be omitted, and contents different from the contents described above will be mainly described.

Coil patterns of the first coil layers 211 and 221 may include both of a coil pattern conductor (or a portion of a coil pattern conductor) having an aspect ratio (AR), which is a ratio ($h_1/w_1$) of a thickness $h_1$ to a width $w_1$, exceeding 1, and a coil pattern conductor (or a portion of a coil pattern conductor) having an aspect ratio (AR), which is a ratio ($h_1/w_2$) of a thickness $h_1$ to a width $w_2$, less than 1. Most of coil pattern conductors of the second coil layers 212 and 222 may have an aspect ratio (AR), which is a ratio ($h_2/w_3$) of a thickness $h_2$ to a width $w_3$, exceeding 1. For example, the coil pattern conductors of the first coil layers 211 and 221 may have a width $w_1$ of about 30 μm to 50 μm, a width $w_2$ of about 90 μm to 150 μm, and a thickness $h_1$ of about 40 μm to 60 μm. The coil pattern conductors of the second coil layers 212 and 222 may have a width $w_3$ of about 40 μm to 60 μm and a thickness $h_2$ of about 40 μm to 70 μm.

Both of the coil patterns of the first coil layers 211 an 221 and the second coil layers 212 and 222 may have plural turns or windings. Here, since the first coil layers 211 and 221 and the second coil layers 212 and 222 are configured of coil patterns having a thin line width, the turns (or windings) of coil patterns of the first coil layers 211 and 221 and the second coil layers 212 and 222 in the horizontal directions, that is, the first direction and/or the second direction, may be basically large. In addition, since the coil layers 211, 212, 221, and 222 may have the same rotation direction and may be electrically connected to each other through vias 214, 224, and 234, the number of turns of coils in the stacking direction, that is, the third direction, may be increased. The number of turns of coil patterns may also be larger or smaller than the number of turns illustrated in FIGS. 26 through 28.

Since most of the coil layers 211, 221, 212, and 222 are formed of coil patterns having a thin line width, a thickness of the coil part may be thin. Here, in order to have a sufficient number of turns, the respective coil layers 211, 221, 212, and 222 may be formed to utilize spaces as much as possible in the horizontal directions, that is, the first direction and/or the second direction. That is, the first coil layers 211 and 221 and the second coil layers 212 and 222 stacked in the vertical direction may have overlapped regions. Therefore, a coil component that is thin and has sufficient coil characteristics (e.g., sufficient inductance) may be implemented.

A line width $w_2$ of coil patterns disposed in the outermost portion (measured from a center of the coil windings) of the first coil layers 211 and 221 may be wider than a line width $w_1$ of coil patterns disposed in an inner portion of the first coil layers 211 and 221. That is, the coil patterns disposed in the inner portion may be implemented to have a relatively thin line width $w_1$, such that the number of turns (or windings) of coil patterns disposed in the inner portion is high, and the coil patterns disposed in the outer portion may be implemented to have a relatively thick line width $w_2$, such that low DC resistance $R_{dc}$ characteristics may be secured. In addition, an interval $L_1$ between adjacent turns (or windings) of the coil patterns of the first coil layers 211 and 221 may be wider than an interval $L_2$ between adjacent turns of the coil patterns of the second coil layers 212 and 222. That is, the interval $L_1$ between the coil patterns of the first coil layers 211 and 221 formed in the inner portion may be relatively wide to decrease a risk of a defect such as occurrence of short-circuits between the coil patterns, or the like, and make the insulating layers 213 and 223 covering the first coil layers 211 and 221 flat, whereby uniformity of coils of the second coil layers 212 and 222 formed in the outer portion may be improved. In addition, the interval $L_2$ between the coil patterns of the second coil layers 212 and 222 formed in the outer portion may be relatively narrow, such that the number of turns of coil part 200 may be generally increased.

Only the first coil layers 211 and 221 and the second coil layers 212 and 222 are illustrated in the drawings, but additional coil layers may be further formed on the second coil layers 212 and 222, and insulating layers in which vias are formed may be disposed between the additional coil layers and the second coil layers 212 and 222, such that the additional coil layers and the second coil layers 212 and 222 may be electrically connected to each other. In addition, additional coil layers may be further formed between the first coil layers 211 and 221 and the second coil layers 212 and 222, and insulating layers in which vias are formed may be disposed between the additional coil layers and the first coil layers 211 and 221 or the second coil layers 212 and 222, such that the additional coil layers and the first coil layers 211 and 221 or the second coil layers 212 and 222 may be electrically connected to each other.

Figure 29:
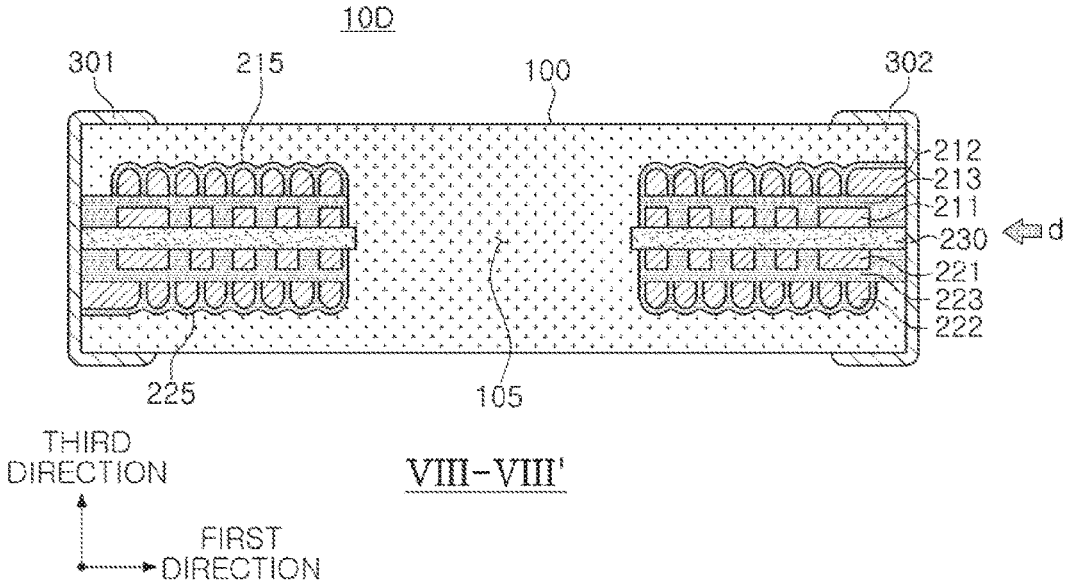
FIG. 29 is a schematic cross-sectional view of the coil component taken along line VIII-VIII' of FIG. 26.

FIG. 29 is a schematic cross-sectional view of the coil component taken along line VIII-VIII' of FIG. 26.

Figure 30:
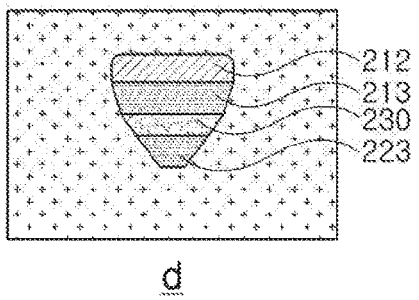
FIG. 30 is a schematic cross-sectional view of a body part of the coil component of FIG. 29 viewed in direction d.

FIG. 30 is a schematic cross-sectional view of a body part of the coil component of FIG. 29 viewed in direction d.

Referring to FIGS. 29 and 30, also in the coil component 10D according to the other example, lead terminals of coil patterns led in order to be connected to the external electrodes 301 and 302 may be supported by the support member 230 and the insulating layers. Therefore, the lead terminals of the coil patterns may be stably formed, and may have excellent connection force to the external electrodes 301 and 302. Meanwhile, although the insulating film 215 is omitted in FIG. 30, the insulating film 215 may also be led. Alternatively, the insulating film 215 may also not substantially remain in the lead cross section.

In addition, referring to FIGS. 29 and 30, also in the coil component 10D according to another example, the right lead cross section of the coil part 200 may have a taper shape of which a width is reduced from the top toward the bottom. Although not illustrated in FIGS. 29 and 30, the left lead cross section of the coil part 200 may also have a taper shape of which a width is reduced from the bottom toward the top. Here, the top and the bottom positions are defined in relation to the third direction shown in FIG. 29. That is, a coil component may be manufactured in which a risk of a defect such as occurrence of short-circuits between the coil patterns, or the like, is decreased, uniformity of coils and a low DC resistance $R_{dc}$ are secured, and thinness is implemented.

Figure 31:
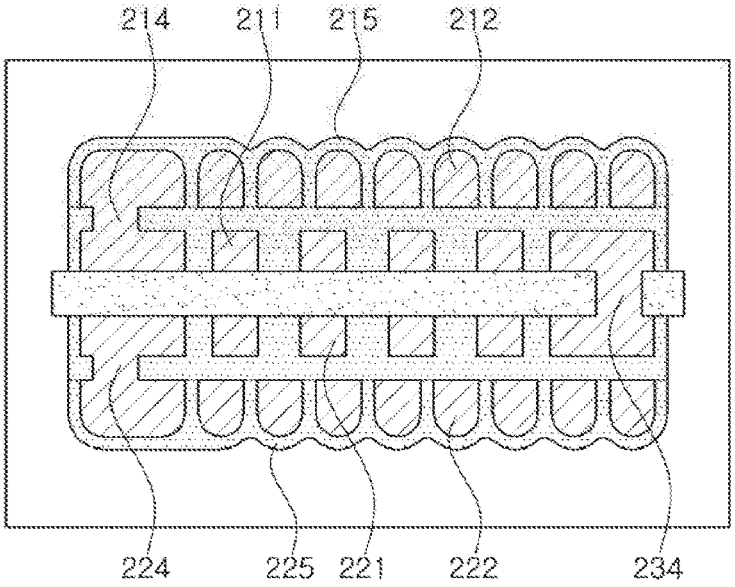
FIG. 31 is a schematic cross-sectional view illustrating electrical connections in the coil part of FIG. 27.

FIG. 31 is a schematic cross-sectional view illustrating electrical connections in the coil part of FIG. 27.

Referring to FIG. 31, the first coil layer 211 disposed in the upper portion and the first coil layer 221 disposed in the lower portion, which are disposed on opposing surfaces of the support member 230, may be electrically connected to each other through the via 234 penetrating through the support member 230. In addition, the first and second coil layers 211 and 212 disposed in the upper portion and the first and second coil layers 221 and 222 disposed in the lower portion may be electrically connected to each other by the vias 214 and 224 each penetrating through the insulating layers 213 and 223, respectively. As a result, all the coil layers 211, 212, 221, and 222 may be electrically connected to each other to form a single coil. Since other contents are the same as the contents described above, a description thereof will be omitted.

Since a method of manufacturing the coil component 10D according to another example is similar to the methods of manufacturing the coil components 10A to 10C described above, a detailed description thereof will be omitted.

Figure 32:
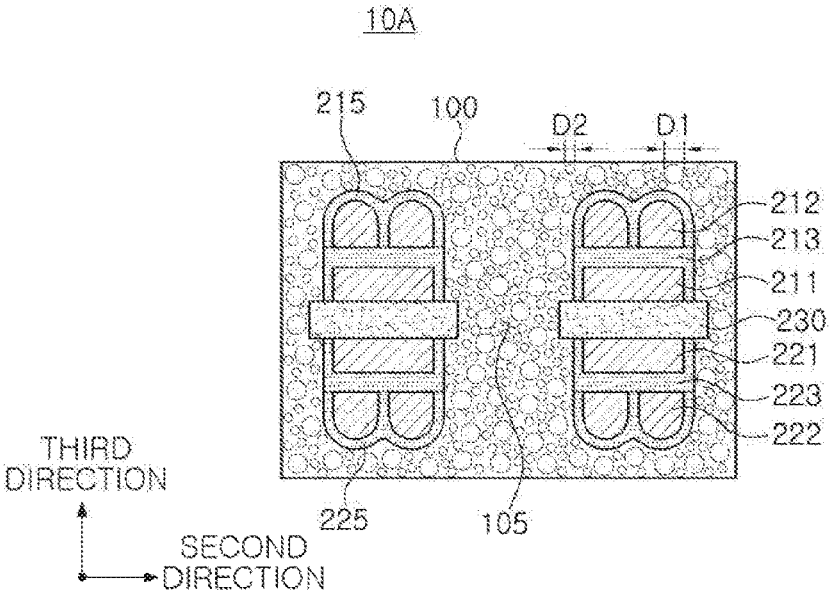
FIG. 32 is a schematic cross-sectional view illustrating an example of a magnetic material.

FIG. 32 is a schematic cross-sectional view illustrating an example of a magnetic material.

Figure 33:
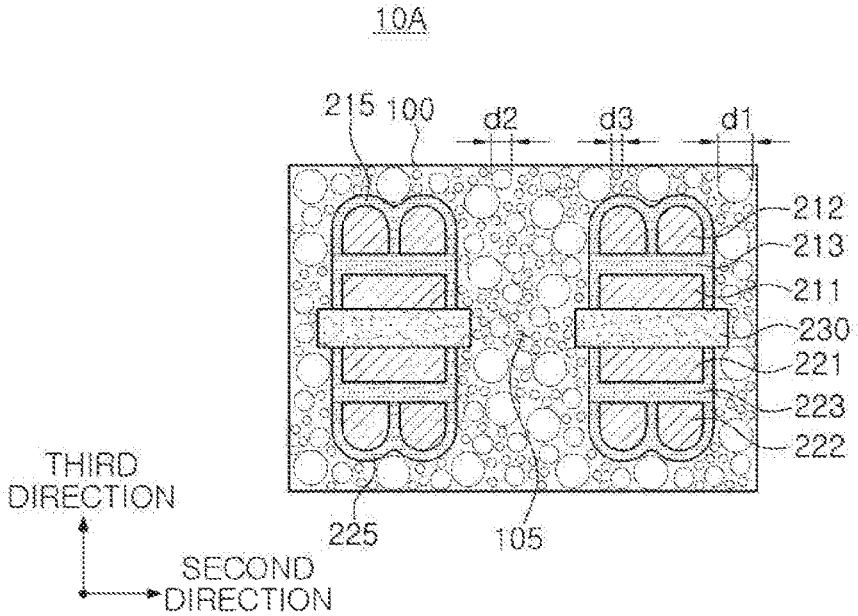
FIG. 33 is a schematic cross-sectional view illustrating another example of a magnetic material.

FIG. 33 is a schematic cross-sectional view illustrating another example of a magnetic material.

Referring to FIGS. 32 and 33, the magnetic material of the body part 100 may be a magnetic material-resin composite in which magnetic metal powder particles and a resin mixture are mixed with each other. The magnetic metal powder particles may contain iron (Fe), chromium (Cr), or silicon (Si) as a main component. For example, the magnetic metal powder particles may contain iron (Fe)-nickel (Ni), iron (Fe), iron (Fe)-chromium (Cr)-silicon (Si), or the like, but are not limited thereto. The resin mixture may contain epoxy, polyimide, liquid crystal polymer (LCP), or the like, but is not limited thereto. The magnetic metal powder particles may be magnetic metal powder particles having at least two average particle sizes $D_1$ and $D_2$ (see, e.g., FIG. 32). Alternatively, the magnetic metal powder particles may be magnetic metal powder particles having at least three average particle sizes $d_1$, $d_2$, and $d_3$ (see, e.g., FIG. 33). In this case, magnetic metal powder particles having different sizes may be fully filled in the magnetic material-resin composite, such that a packing factor of the magnetic material-resin composite may be increased. As a result, an inductance of the coil component may be increased.

FIG. 34 is a schematic view illustrating an example of a coil component to which an isotropic plating technology is applied.

The coil component to which the isotropic plating technology is applied may be manufactured by, for example, forming coil patterns 1021 and 1022 having a planar coil shape on both surfaces of a support member 1030 by the isotropic plating technology, embedding the coil patterns 1021 and 1022 using a magnetic material to form a body part 1010, and forming external electrodes 1041 and 1042 electrically connected to the coil patterns 1021 and 1022 on outer surfaces of the body part 1010. The isotropic plating technology has a limitation in implementing a high aspect ratio as illustrated in FIG. 34, since plating is performed at the time of performing an electroplating method, such that coil patterns are simultaneously grown in a thickness direction and a width direction.

FIG. 35 is a schematic view illustrating an example of a coil component to which an anisotropic plating technology is applied.

The coil component to which the anisotropic plating technology is applied may be manufactured by, for example, forming coil patterns 2021 and 2022 having a planar coil shape on both surfaces of a support member 2030 by the anisotropic plating technology, embedding the coil patterns 2021 and 2022 using a magnetic material to form a body part 2010, and forming external electrodes 2041 and 2042 electrically connected to the coil patterns 2021 and 2022 on outer surfaces of the body part 2010. In the case of applying the anisotropic plating technology, a high aspect ratio may be implemented, but uniformity of plating growth may be decreased due to an increase in an aspect ratio, and a dispersion of a plating thickness is wide, such that short-circuits between the coil patterns may easily occur.

Figure 36:
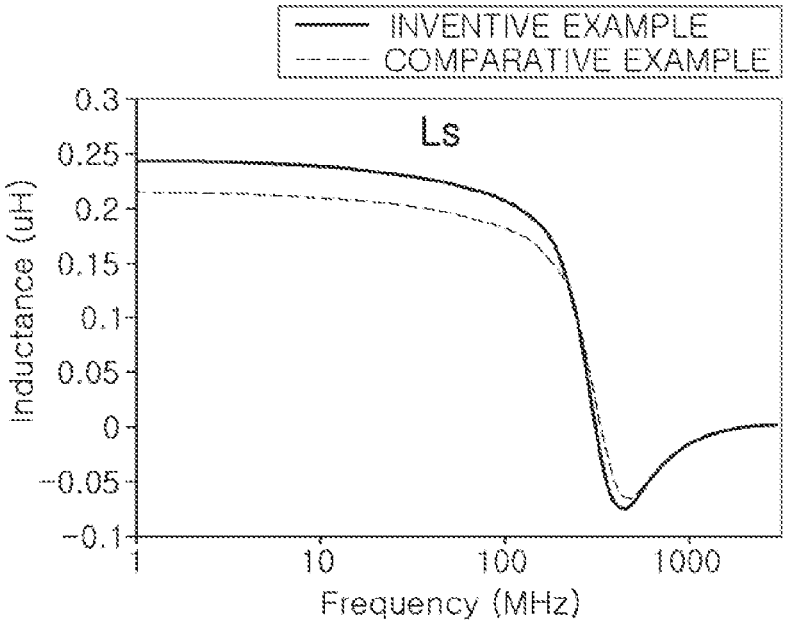
FIG. 36 is a view illustrating a comparison result of inductances of various types of coil components.

FIG. 36 is a view illustrating a comparison result of inductances of various types of coil components.

Figure 37:
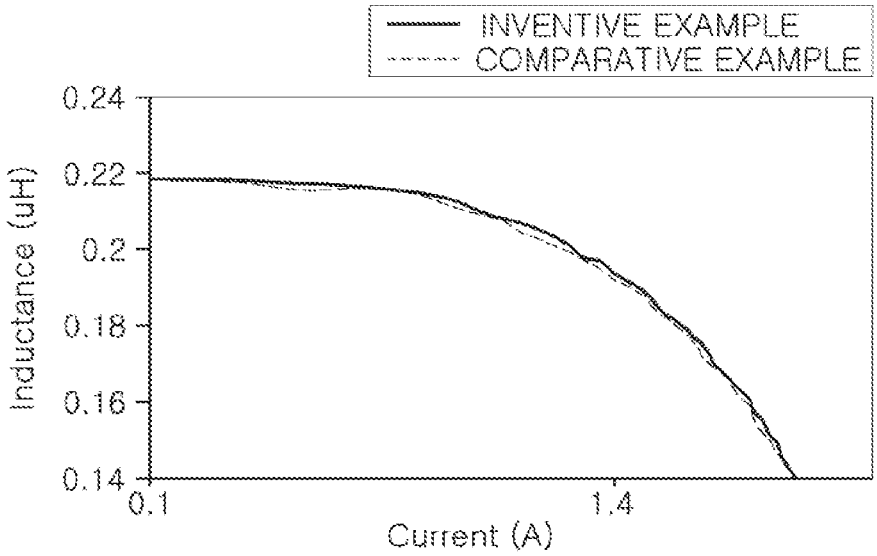
FIG. 37 is a view illustrating a comparison result of saturation current characteristics of various types of coil components.

FIG. 37 is a view illustrating a comparison result of saturation current characteristics of various types of coil components.

Figure 38A:
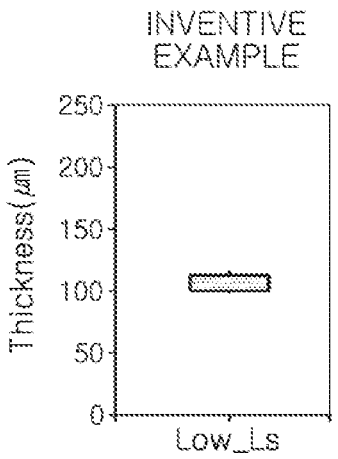
FIGS. 38A and 38B are views illustrating a comparison of plating dispersion results of various types of coil components.
Figure 38B:
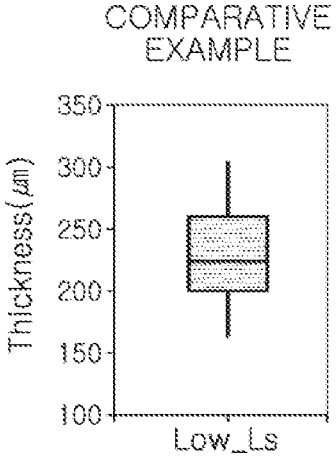

FIGS. 38A and 38B are views illustrating a comparison of plating dispersion results of various types of coil components.

In FIGS. 36, 37, 38A, and 38B, the Inventive Example label indicates a measurement result of an inductance, a saturation current, and a plating dispersion of the coil component according to the present disclosure, more specifically, the coil component 10A according to an exemplary embodiment. Meanwhile, the Comparative Example label indicates a measurement result of an inductance, a saturation current, and a plating dispersion of a coil component manufactured using vertical anisotropic plating, for example, the coil component illustrated in FIG. 35.

Referring to FIGS. 36, 37, 38A, and 38B, it may be appreciated that an area in which the coil part and the magnetic material in the body part contact each other in the same space may be increased in the coil component according to the present disclosure as compared with the coil component manufactured using only the vertical anisotropic plating, such that a higher inductance may be secured in the coil component according to the present disclosure as compared with the coil component manufactured using only the vertical anisotropic plating. Additionally, DC bias characteristics may be relatively increased in the coil component according to the present disclosure as compared with the coil component manufactured using only the vertical anisotropic plating. In addition, it may be appreciated that a process distribution (or variability in a process of forming coil patterns) may be decreased, such that inductance process force of a product requiring many efforts at the time of being manufactured may be increased.

As set forth above, according to the exemplary embodiment, a new coil component in which a risk of a defect such as occurrence of short-circuits, or the like, is decreased and uniformity of coils and a low DC resistance $R_{dc}$ are secured, and thinness is implemented, and a method of manufacturing the same may be provided.

Meanwhile, a phrase 'electrically connected' includes both of a case in which one component is physically connected to another component and a case in which one component is not physically connected to another component.

In addition, a term 'example' used in the present disclosure does not mean the same exemplary embodiment, but is provided in order to emphasize and describe different unique features. However, the above suggested examples may also be implemented to be combined such that a feature from one example can be included in another example. For example, even though particulars described in a specific example are not described in another example, it may be understood such particulars can be incorporated in the other example unless described otherwise.

In addition, terms used in the present disclosure are used only in order to describe an example rather than limit the present disclosure. Here, singular forms include plural forms unless interpreted otherwise in a context.

While exemplary embodiments have been shown and described above, it will be apparent to those skilled in the art that modifications and variations could be made without departing from the scope of the present invention as defined by the appended claims.

What is claimed is:

1. A coil component comprising: a body part containing a magnetic material; a coil part disposed in the body part; and an electrode part disposed on the body part, wherein the coil part includes a support member, a first coil layer directly disposed on at least one surface of the support member, a first insulating layer stacked on at least one surface of the support member, having a composition different from the support member, and covering the first coil layer, and a second coil layer directly disposed on the first insulating layer, and the first and second coil layers are electrically connected to each other, and the second coil layer has a larger number of coil turns than the first coil layer; wherein the first coil layer includes a coil pattern having an aspect ratio less than 1, and the second coil layer includes a coil pattern having an aspect ratio exceeding 1.

2. The coil component of claim 1, wherein the first and second first coil layers are each disposed on a respective surface of opposing surfaces of the support member, first and second first insulating layers are each disposed on a respective surface of the opposing surfaces of the support member, and each cover a respective first coil layer of the first and second first coil layers, the first and second coil layers are each disposed on a respective first insulating layer of the first and second first insulating layers, first vias penetrating through the first and second first insulating layers electrically connect the first and second first coil layers to the first and second coil layers, and a second via penetrating through the support member electrically connects the first and second first coil layers respectively formed on opposing surfaces of the support member to each other.

3. The coil component of claim 1, wherein the coil pattern of the first coil layer includes a single turn, and the coil pattern of the second coil layer includes a plurality of turns.

4. The coil component of claim 1, wherein a ratio (y/x) of y to x is greater than or equal to 2, in which the number of turns of the coil pattern of the first coil layer is x and the number of turns of the coil pattern of the second coil layer is y.

5. The coil component of claim 1, wherein a ratio (H/T) of H to T is less than or equal to 0.15 in which T is a thickness of the body part and H is a thickness of the support member.

6. The coil component of claim 1, wherein the magnetic material contains a plurality of magnetic metal powder particles having different average particle sizes and a resin mixture.

7. The coil component of claim 1, wherein at least one lead cross section of the coil part includes a lead cross section of the support member, a lead cross section of the first insulating layer disposed on the lead cross section of the support member, and a lead cross section of the second coil layer disposed on the lead cross section of the first insulating layer.

8. The coil component of claim 7, wherein the at least one lead cross section of the coil part has a tapered shape.

9. The coil component of claim 1, wherein the second coil layer includes another coil pattern having an aspect ratio less than 1.

10. The coil component of claim 9, wherein the coil pattern of the first coil layer includes a single turn, and the another coil pattern of the second coil layer includes a single turn.

11. The coil component of claim 1, wherein the first coil layer includes another first coil pattern having an aspect ratio exceeding 1, and the coil pattern of the second coil layer includes plural coil patterns having an aspect ratio exceeding 1.

12. The coil component of claim 11, wherein the coil pattern of the first coil layer includes a plurality of turns, and the coil pattern of the second coil layer includes a plurality of turns.

13. The coil component of claim 11, wherein a line width of the second coil pattern disposed in an outermost portion of the first coil layer is wider than a line width of the first coil pattern disposed in an inner portion of the first coil layer.

14. The coil component of claim 11, wherein an interval between turns of the coil patterns of the first coil layer is wider than an interval between turns of the coil patterns of the second coil layer.

15. A coil component comprising:

a body part containing a magnetic material;

a coil part disposed in the body part; and an electrode part disposed on the body part, wherein the coil part includes a support member, a first coil layer disposed on one surface of the support member, a first insulating layer stacked on the one surface of the support member and covering the first coil layer, and a second coil layer disposed on the first insulating layer, and the first and second coil layers are electrically connected to each other, a conductor of the first coil layer has an aspect ratio $h_1/w_1$ less than 1 where a thickness $h_1$ is measured orthogonally to the one surface of the support member on which the first coil layer is disposed and a width $w_1$ is measured parallel to the one surface of the support member, and a conductor of the second coil layer has an aspect ratio $h_2/w_2$ exceeding 1 where a thickness $h_2$ is measured orthogonally to the one surface of the support member on which the first coil layer is disposed and a width $w_2$ is measured parallel to the one surface of the support member.

16. The coil component of claim 15, wherein the coil part further includes a third coil layer disposed on another surface of the support member opposite to the one surface, a second insulating layer stacked on the other surface of the support member and covering the third coil layer, and a fourth coil layer disposed on the second insulating layer, and the third and fourth coil layers are electrically connected to each other and to the first and second coil layers, and the third coil layer has an aspect ratio $h_2/w_2$ less than 1 where a thickness $h_2$ is measured orthogonally to the other surface of the support member on which the third coil layer is disposed and a width $w_2$ is measured parallel to the other surface of the support member.

17. The coil component of claim 15, wherein the second coil layer includes a lead portion connecting the coil part to an external electrode of the electrode part, and wherein a width of the lead portion measured parallel to the one surface of the support member is greater than a width of the support member disposed below the lead portion.

18. The coil component of claim 15, wherein the first coil layer disposed on the one surface of the support member has a plurality of coil turns, and the conductor of the first coil layer has a first width in a first coil turn of the first coil layer and a second width different from the first width in a second coil turn of the first coil layer.

19. The coil component of claim 15, wherein the second coil layer has a larger number of coil turns than the first coil layer.

20. The coil component of claim 19, wherein the second coil layer has more than one coil turn within the width $w_1$ of the conductor of the first coil layer.

* * * * *